US007511428B2

(12) United States Patent
Nishitani et al.

(10) Patent No.: US 7,511,428 B2
(45) Date of Patent: Mar. 31, 2009

(54) PLASMA DISPLAY PANEL

(75) Inventors: Hikaru Nishitani, Nara (JP); Yukihiro Morita, Hirakata (JP); Masatoshi Kitagawa, Hirakata (JP)

(73) Assignee: Panasonic Corporation, Osaka (JP)

( * ) Notice: Subject to any disclaimer, the term of this patent is extended or adjusted under 35 U.S.C. 154(b) by 480 days.

(21) Appl. No.: 10/530,500

(22) PCT Filed: Oct. 10, 2003

(86) PCT No.: PCT/JP03/13023

§ 371 (c)(1),
(2), (4) Date: Oct. 31, 2005

(87) PCT Pub. No.: WO2004/038753

PCT Pub. Date: May 6, 2004

(65) Prior Publication Data

US 2006/0152142 A1 Jul. 13, 2006

(30) Foreign Application Priority Data

Oct. 22, 2002 (JP) ..... 2002-307066
Oct. 29, 2002 (JP) ..... 2002-314790

(51) Int. Cl.
*H01J 17/49* (2006.01)
*H01J 1/62* (2006.01)

(52) U.S. Cl. ..... 313/587; 313/586; 313/485

(58) Field of Classification Search ..... 313/582, 313/586, 587, 485–487
See application file for complete search history.

(56) References Cited

U.S. PATENT DOCUMENTS 3,996,489 A 12/1976 Byrum, Jr. et al.
5,156,764 A * 10/1992 Kaneda et al. ..... 252/301.4 P
5,454,861 A 10/1995 Hasegawa et al.
6,475,049 B2 * 11/2002 Kim et al. ..... 445/24
2002/0047510 A1 4/2002 Bechtel et al.
2002/0050792 A1 * 5/2002 Shirozu ..... 313/586
2002/0089284 A1 * 7/2002 Hayashi ..... 313/582

(Continued)

FOREIGN PATENT DOCUMENTS

EP 1 300 869 4/2003

(Continued)

OTHER PUBLICATIONS

Ronda, C.R., "Recent achievements in research on phosphors for lamps and displays", Journal of Luminescence, 1997, pp. 49-54.

*Primary Examiner*—Nimeshkumar D. Patel
*Assistant Examiner*—Anthony T Perry

(57) ABSTRACT

A plasma display panel having a dielectric protection layer (14) including MgO and phosphorlayers (25R, 25G, 25B) for red, green, and blue respectively wherein none of the phosphor layers contain any member of the group consisting of Group IV elements, transition metals, alkali metals, and alkaline earth metals, or wherein all the phosphor layers each contain a specific amount of one or more members of the group consisting of Group IV group elements, transition metals, alkali metals and alkaline earth metals. In such a plasma display panel, changes over the course of time in the impedance of the dielectric protection layer (14) is suppressed, and the phosphor layers are uniform with respect to the directional characteristics of the changes of the impedances, which results in suppression of occurrence of black noise.

10 Claims, 8 Drawing Sheets

U.S. PATENT DOCUMENTS

2003/0030377 A1 * 2/2003 Hirano et al. ..... 313/587

FOREIGN PATENT DOCUMENTS

| | | | | |
|---|---|---|---|---|
| JP | 11-035372 | | | 2/1999 |
| JP | 11-43670 | | | 2/1999 |
| JP | 11095420 | A | * | 4/1999 |
| JP | 11-339665 | | | 12/1999 |
| JP | 2000-103614 | | | 4/2000 |
| JP | 2001-110321 | | | 4/2001 |
| JP | 2001107045 | A | * | 4/2001 |
| JP | 2001-329256 | | | 11/2001 |
| WO | WO01/31673 | | * | 5/2001 |

* cited by examiner

Si CONTENT RATIO VS IMPEDANCE

PLASMA DISPLAY PANEL

TECHNICAL FIELD

The present invention relates to plasma display panels used as display devices or the like, and in particular to a technique for inhibiting degradation of image quality that may occur after plasma display panels have been driven for a long period of time.

BACKGROUND ART

In recent years, there are demands that display devices have a higher definition, a larger screen, and a flat dimension, and various types of display devices have been developed. Among those, gas discharge panels such as plasma display panels (hereafter referred to as "PDP"s) are receiving attentions as typical display devices.

In a PDP, a front panel and a back panel are disposed so as to oppose each other with barrier ribs interposed therebetween. The perimeter areas of the panels are sealed together so as to form a space (discharge space) between the panels, and discharge gas (for example, a Ne—Xe gas mixture of 53.2 kPa to 79.8 kPa) is sealed in the space. The front panel has a front glass substrate, a pair of display electrodes that are provided in stripes on the surface of the front glass substrate, a dielectric glass layer covering them, and a dielectric protection layer (MgO) that further covers the dielectric glass layer.

The back panel has a back glass substrate, a plurality of address electrodes that are provided in stripes on the surface of the back glass substrate, a dielectric glass layer covering them, and barrier ribs that are disposed on the dielectric glass layer so that each of them stands between two address electrodes. Further, on the back panel, phosphor layers for red (R), green (G), and blue (B) are disposed on the walls of the grooves each defined by adjacent barrier ribs and the dielectric glass layer. As examples of phosphor members included in the phosphor layers, generally speaking, $Y_2O_3$:Eu is used for red, $Zn_2SiO_4$:Mn is used for green, and $BaMgAl_{10}O_{17}$:$Eu^{2+}$ is used for blue. Especially, as the phosphor member for green, a substance that contains Si (silicon) in its composition is sometimes used in order to improve the luminance of the panel when the panel is driven.

In principle, the PDP described above is driven using a method (called the intrafield time-division grayscale display method) in which binary values for turning the light on and off are used, and for each color, one field is divided into a plurality of sub-fields so that a lighting period is subject to a time division, and different levels of gray are expressed with combinations of the sub-fields. An image is displayed on the panel using the ADS (Address Display-Period Separation) method according to which, in each sub-field, a series of operations is performed, which is to perform writing in a discharge cell to turn the light on during an address period and to maintain the discharge during a sustain period that follows the address period.

As described above, when a light emission drive of a PDP is performed, in order to display an image, wall charges are generated on the surface of the dielectric protection layer in selected discharge cells during an address period, and discharges occur during a sustain period. The amount of the wall charges being accumulated is influenced by the impedance of the dielectric protection layer; therefore, when the impedance of the dielectric protection layer is too much lower or too much higher than a predetermined value, what is called "black noise" may occur, which means that discharges during the sustain period do not occur in a normal manner. Further, when the impedance is too high, in order to have discharges occur during a sustain period, it is required to apply a high voltage, and thereby the consumption electric power becomes large.

A technique has been developed to make the impedance of a dielectric protection layer at a desired level so that the electron release characteristics of the dielectric protection layer are optimized, by adding, to the dielectric protection layer, a Group IV element such as Si, or a transition metal such as manganese (Mn) and nickel (Ni), or an alkali metal, or an alkaline earth metal (The Unexamined Japanese Patent Application Publication No. 10-334809).

However, a PDP sometimes experiences a problem that in some of the discharges cells, the impedance of the dielectric protection layer gradually changes from the initial set value as the PDP goes through its driving period. When the impedance of the dielectric protection layer changes as the PDP goes through its driving period, after the PDP is driven for a long period of time, what is called "black noise" will occur, which means that no discharge is generated during the sustain period in a discharge cell in which the light is supposed to be turned on. This phenomenon similarly occurs even in a case where, like the PDP disclosed in the publication cited above, Si is added to the dielectric protection layer during the manufacturing process.

DISCLOSURE OF THE INVENTION

In order to solve the problem mentioned above, an object of the present invention is to provide a plasma display panel whose image quality is maintained high regardless of the length of the driving period by inhibiting black noise that may occur because the impedance of the dielectric protection layer changes as the panel goes through its driving period as well as to achieve a high luminance level throughout the whole panel.

The inventors of the present invention have found out that in a conventional PDP as described above, black noise, which is prominent when a PDP has gone through a long driving period, is caused by adhesion of elements such as Si, zinc (Zn), oxygen (O), or Mn to the surface of the dielectric protection layer while the panel is driven. These elements that cause black noise are mainly included in the phosphor layers during the PDP manufacturing process. Being influenced by discharges during the driving of the panel, these elements disperse into the discharge spaces and adhere to the surface of the dielectric protection layer. After elements keep adhering to the surface of the dielectric protection layer and when the amount of adhesion reaches a certain level, the impedance of the dielectric protection layer deviates from a range in which it is supposed to be.

In addition, the impedance of a dielectric protection layer changes with variations among discharges cells for R, G, and B, because of the differences with respect to the compositions of the phosphor members included in the discharge cells. Thus, even if the driving voltage or the like is adjusted, it is not possible to inhibit black noise from occurring throughout the whole panel.

In view of the facts and knowledge learned from the research and development, the present invention aims to, by making adjustment in the driving method and the like, control the changes in the impedance of the dielectric protection layer that may be caused after a PDP has been driven for a long period of time, in order to inhibit occurrence of black noise. More specifically, the present invention is characterized with arrangements as described below:

(1) The present invention provides a plasma display panel in which a pair of substrates are disposed so as to oppose each other and have a discharge space therebetween and in which a dielectric protection layer including MgO and phosphor layers for red, green, and blue respectively are formed so as to face the discharge space, wherein none of phosphor members included in the phosphor layers contain, in a composition thereof, a Group IV element.

In the PDP described in (1), since none of the phosphor members for the three colors contain a Group IV element, in their composition, even after the PDP is driven for a long period of time, the amount of Group IV elements that disperse from the phosphor layers into the discharge spaces are suppressed to be small; therefore, the amount of Group IV elements that adhere to the surface of the dielectric protection layer is also small. In other words, even if the phosphor layers include some Group IV elements in the regions besides the phosphor members at a level of impurities, since the phosphor members which occupy, in terms of mass ratio, the largest part of the phosphor layers contain in their composition no Group IV element, there is substantially no influence exerted on the discharge characteristics of the dielectric protection layer. Thus, according to the PDP of the present invention, the driving of the panel does not cause the impedance of the dielectric protection layer to change from the one that is set at the designing stage.

Accordingly, with the PDP described in (1) above, by setting the impedance of the dielectric protection layer at a proper range during the designing stage, occurrence of black noise does not increase while the panel is driven. Even the panel is driven for a long period of time, degradation of image quality due to black noise is less likely to happen.

(2) It is desirable to make the PDP described as (1) have an arrangement wherein none of the phosphor layers are made of a substance that contains any Group IV element, since it is possible to make the change in the discharge characteristics of the dielectric protection layer caused by the driving of the panel none or almost none.

(3) The present invention also provides a plasma display panel in which a pair of substrates are disposed so as to oppose each other and have a discharge space therebetween and in which a dielectric protection layer including MgO and phosphor layers for red, green, and blue respectively are formed so as to face the discharge space, wherein each of the phosphor layers contains at least one Group IV element.

With this arrangement of the PDP described in (3), since a Group IV element is included in the phosphor layers of all of the three colors, the Group IV element disperses into the discharge spaces from the phosphor layers due to the discharges generated during the driving of the panel; however, since the Group IV element is included in the phosphor layers of all of the three colors, it is possible to make dispersion characteristics of the Group IV element uniform among the phosphor layers of the three colors. Consequently, in such a PDP, although the Group IV elements disperse due to the driving of the panel, the Group IV elements adhere to the surfaces of the dielectric protection layer in a uniform manner in all of the discharge cells. With this arrangement, in the PDP described in (3), it is possible to make the directional characteristics uniform as a whole, of the changes over the course of time in the impedance of the dielectric protection layer corresponding to the discharge cells of the colors of R, G, and B.

Further, in the PDP described in (3), since the Group IV element is included in the phosphor layers, the Group IV element that has dispersed into the discharge spaces from the phosphor layers during the driving of the panel adheres to the surface of the dielectric protection layer and thereby it is possible to achieve an effect of making the actual discharge period per pulse longer. Accordingly, as contrasted with the case where no Group IV element is included in the phosphor layers at all, it is possible to improve the luminance of the panel. Consequently, with the PDP as described in (3), it is possible to conjecture the convergence of the impedance over the course of time and to inhibit occurrence of black noise by adjusting the driving voltage over the course of time.

Thus, with the PDP of the present invention, it is possible to improve the luminance of the panel by having Group IV elements contained in the phosphor layers and to maintain superior image quality even after the panel has been driven for a long period of time.

(4) It is desirable to make the PDP described as (3) have an arrangement wherein a content ratio of said at least one Group IV element in each of the phosphor layers is no larger than 5,000 mass ppm, since it is possible to make the change in the impedance of the dielectric protection layer due to the driving of the panel substantially the same as the change that occurs in the case where a panel comprises phosphor layers that include no Group IV element. Further, with the PDP as described in (4), since all of the phosphor layers include at least one Group IV element although in a very small quantity, it is possible to maintain the luminance of the panel high.

It should be noted that the reason why it is desirable to keep the content ratio of the Group IV elements equal to or less than 5,000 mass ppm is confirmed with the confirmation experiments described later.

(5) It is desirable to keep the content ratio of the IV elements to be included equal to or less than 5,000 mass ppm, as described above. In order to achieve the effect of improving the luminance by having a very small amount of Group IV element contained, it is further desirable to make the lower limit 100 mass ppm.

(6) It is desirable to make the PDP described as (3) have an arrangement wherein a phosphor member included in at least one of the phosphor layers contains, in a composition thereof, at least one Group IV element. In other words, it is desirable to arrange it so that at least one Group IV element is included in the composition of the phosphor member for the following reasons:

For example, in the process of forming a phosphor layer, if impurities get mixed in the phosphor paste and the blending step is not complete, the distribution of the impurities may be different between in the upper part of the container and in the lower part of the container. Further, generally speaking, during the baking step, there is tendency that the distribution ratio of the impurities in the surface region of the layer is small and the distribution ratio in the inner region of the layer is large. When the distribution of the impurities is not uniform in the direction of the thickness of the phosphor layer like this, since the impedance of the dielectric protection layer is not stable after the PDP has been driven for a long period of time, there will be variations within a plane, and there will also be variations between the substrates.

In contrast, as in the PDP described in (6), in the case where at least one Group IV element is included in the composition of the phosphor member, a larger amount of the Group IV element, which is an additive, exists in proportion to the amount of the phosphor member; therefore, an effect is obtained that the problem described above can be solved to a large extent.

(7) It is further acceptable to make the PDP described in (3) have an arrangement wherein a content ratio of said at least one Group IV element in each of the phosphor layers is within a range between 100 mass ppm and 50,000 mass ppm inclusive, and the content ratio is substantially same for all of the phosphor layers.

In the PDP as described in (7), said at least one Group IV element is included in each phosphor layer at the ratio between 100 mass ppm and 50,000 mass ppm inclusive. The upper limit of the content ratio in this case is approximately ten times higher than the ratio in the PDP described in (4), and it is superior in terms of the luminance of the panel.

Further, in the PDP described in (7), the content ratios of said at least one Group IV element included in each phosphor layers are substantially the same for all the colors of R, G, and B; therefore, it is possible to more uniformly converge the impedance of the dielectric protection layer when the driving of the panel has lasted for a long period of time. Accordingly, with the PDP described in (7), it is possible to more easily adjust, over the course of time, the driving voltage being prearranged than in the case of the PDP described in (3), and it is possible to more effectively inhibit occurrence of black noise.

Consequently, the PDP of the present invention is good at maintaining high luminance of the panel and maintaining superior image quality from the initial stage of the driving and even after the panel has been driven for a long period of time.

(8) It is desirable to make the PDP described in (7) have an arrangement wherein variations among the phosphor layers with respect to the content ratio of said at least one Group IV element are no larger than 20,000 mass ppm, in view of the convergence of the impedance.

(9) It is acceptable to make the PDP described in (7) have an arrangement wherein for each of the phosphor layers, a phosphor member containing, in a composition thereof, at least one Group IV element is selected so as to be included in the phosphor layer. This PDP has the advantageous features of the PDP described in (6), in addition to the advantageous features of the PDP described in (7).

(10) It is desirable to make the PDP described in (9) have an arrangement wherein said at least one Group IV element contained in the composition of the phosphor member is in common with all of the phosphor layers, in view of making the directional characteristics uniform, of the change in the impedance of the dielectric protection layer.

(11) It is desirable to make the PDP described in (1) or (3) have an arrangement wherein Si is selected as said Group IV element, in view of both improvement of the luminance of the panel and inhibition of black noise occurrence.

(12) It is acceptable to make the PDP described in (11) have an arrangement wherein compositions of the phosphor members are $Y_2SiO_5$:Eu for red, $Zn_2SiO_4$:Mn for green, and $Y_2SiO_3$:Ce for blue.

(13) It is possible to achieve the same effects by making the PDP described in (3) have an arrangement wherein in each of the phosphor layers, said at least one Group IV element contained is a compound being distinct from any phosphor members included in the phosphor layer.

As explained so far, by defining the content ratio of said at least one Group IV element included in each phosphor layer so as to be the value mentioned above (including the case where the content ratio is 0 mass ppm, which means that no Group IV element is included), it is possible to inhibit occurrence of black noise that may be caused after the panel has been driven for a long period of time while improving the luminance of the panel. It is possible to achieve the advantageous effects by defining the content ratio, not only in the case where the content ratio of the at least one Group IV element included in each phosphor layer is defined but also in the case where the content ratio of transition metal (W, Mn, Fe, Co, Ni), alkali metal, or alkaline earth metal (except for Mg) is defined. The following sections of (14) through (34) describe these cases.

(14) The present invention also provides a plasma display panel in which a pair of substrates are disposed so as to oppose each other and have a discharge space therebetween and in which a dielectric protection layer including MgO and phosphor layers for red, green, and blue respectively are formed so as to face the discharge space, wherein none of phosphor members included in the phosphor layers contain, in a composition thereof, any member of the group consisting of W, Mn, Fe, Co, and Ni.

(15) The present invention also provides the PDP as described in (14) wherein none of the phosphor layers are made of a substance that contains any member of the group consisting of W, Mn, Fe, Co, and Ni.

(16) The present invention provides a plasma display panel in which a pair of substrates are disposed so as to oppose each other and have a discharge space therebetween and in which a dielectric protection layer including MgO and phosphor layers for red, green, and blue respectively are formed so as to face the discharge space, wherein each of the phosphor layers contains at least one transition metal.

(17) The present invention also provides the PDP as described in (16) wherein a content ratio of said at least one transition metal in each of the phosphor layers is no larger than 30,000 mass ppm.

(18) The present invention provides the PDP as described in (16) wherein a content ratio of said at least one transition metal in each of the phosphor layers is within a range between 500 mass ppm and 30,000 mass ppm inclusive.

(19) The present invention also provides the PDP as described in (16) wherein a phosphor member included in at least one of the phosphor layers contains, in a composition thereof, at least one transition metal.

(20) The present invention also provides the PDP as described in (16) wherein said at least one transition metal is selected from the group consisting of W, Mn, Fe, Co, and Ni.

(21) The present invention also provides the PDP as described in (20) wherein a content ratio of said at least one transition metal in each of the phosphor layers is within a range between 300 mass ppm and 120,000 mass ppm inclusive, and the content ratio is substantially same for all of the phosphor layers.

(22) The present invention also provides the PDP as described in (21) wherein variations among the phosphor layers with respect to the content ratio of said at least one transition metal are no larger than 40,000 mass ppm.

(23) The present invention also provides the PDP as described in (21) wherein for each of the phosphor layers, a phosphor member containing, in a composition thereof, at least one transition metal is selected so as to be included in the phosphor layer.

(24) The present invention also provides the PDP as described in (23) wherein said at least one transition metal contained in the composition of the phosphor member is in common with all of the phosphor layers.

(25) The present invention also provides a plasma display panel in which a pair of substrates are disposed so as to oppose each other and have a discharge space therebetween and in which a dielectric protection layer including MgO and phosphor layers for red, green, and blue respectively are formed so as to face the discharge space, wherein none of phosphor members included in the phosphor layers contain, in a composition thereof, any member of the group consisting of alkali metals and alkaline earth metals other than Mg.

(26) The present invention also provides the PDP as described in (25) wherein none of the phosphor layers are made of a substance that contains any member of the group consisting of alkali metals and alkaline earth metals other than Mg.

(27) The present invention also provides a plasma display panel in which a pair of substrates are disposed so as to oppose each other and have a discharge space therebetween and in which a dielectric protection layer including MgO and phosphor layers for red, green, and blue respectively are formed so as to face the discharge space, wherein each of the phosphor layers contains at least one member of the group consisting of alkali metals and alkaline earth metals other than Mg.

(28) The present invention also provides the PDP as described in (27) wherein a total content ratio of said at least one member in each of the phosphor layers is no larger than 60,000 mass ppm.

(29) The present invention also provides the PDP as described in (27) wherein a total content ratio of said at least one member in each of the phosphor layers is within a range between 1,000 mass ppm and 60,000 mass ppm inclusive.

(30) The present invention also provides the PDP as described in (29) wherein a phosphor member included in at least one of the phosphor layers contains, in a composition thereof, at least one member of the group consisting of alkali metals and alkaline earth metals other than Mg.

(31) The present invention also provides the PDP as described in (27) wherein a total content ratio of said at least one member in each of the phosphor layers is within a range between 300 mass ppm and 120,000 mass ppm inclusive, and the total content ratio is substantially same for all of the phosphor layers.

(32) The present invention also provides the PDP as described in (31) wherein variations among the phosphor layers with respect to the total content ratio of said at least one member are no larger than 40,000 mass ppm.

(33) The present invention also provides the PDP as described in (31) wherein for each of the phosphor layers, a phosphor member containing, in a composition thereof, at least one member of the group consisting of alkali metals and alkaline earth metals other than Mg is selected so as to be included in the phosphor layer.

(34) The present invention also provides the PDP as described in (31) wherein said at least one member contained in the composition of the phosphor member is in common with all of the phosphor layers.

In view of the PDPs described in (1), (14), and (25), it is possible to achieve the same effects as with the aforementioned PDPs, with PDPs having the following arrangements:

(35) The present invention further provides a plasma display panel in which a pair of substrates are disposed so as to oppose each other and have a discharge space therebetween and in which a dielectric protection layer including MgO and phosphor layers for red, green, and blue respectively are formed so as to face the discharge space, where in none of phosphor members included in the phosphor layers contain, in a composition thereof, any member of the group consisting of Group IV elements, W, Mn, Fe, Co, Ni, alkali metals, and alkaline earth metals other than Mg.

(36) The present invention further provides the PDP as described in (35) wherein none of the phosphor layers are made of a substance that contains any member of the group consisting of Group IV elements, W, Mn, Fe, Co, Ni, alkali-metals, and alkaline earth metals other than Mg.

Further, it is desirable to realize one of the features described below in order to set the impedance of the dielectric protection layer at the initial stage of the driving of the panel in a proper range and achieve high image quality.

(37) One of the features can be realized by making the PDP as described in any of (1), (3), (14), (16), (25), (27), and (35) have an arrangement wherein the dielectric protection layer contains at least one Group IV element.

(38) Another feature can be realized by making the PDP as described in (37) have an arrangement wherein a content ratio of said at least one Group IV element in the dielectric protection layer is within a range between 500 mass ppm and 2,000 mass ppm inclusive.

(39) Another feature can be realized by making the PDP as described in any of (1), (3), (14), (16), (25), (27), and (35) have an arrangement wherein the dielectric protection layer contains at least one transition metal.

(40) Another feature can be realized by making the PDP as described in (39) have an arrangement wherein a content ratio of said at least one transition metal in the dielectric protection layer is within a range between 1,500 mass ppm and 6,000 mass ppm.

(41) Another feature can be realized by making the PDP as described in any of (1), (3), (14), (16), (25), (27), and (35) have an arrangement wherein the dielectric protection layer contains at least one member of the group consisting of alkali metals and alkaline earth metals. It should be noted that among elements that maybe included in the dielectric protection layer, although Mg, which makes up MgO being the main constituent element of the dielectric protection layer, is normally classified as an alkaline earth metal, the alkaline earth metals described here are other kinds of alkaline earth metal element besides Mg.

Further, the present invention provides the following arrangements:

(42) The present invention provides the PDP as described in any of (3), (16), and (27), wherein at least part of a surface of one or more of the phosphor layers facing the discharge space is covered with a phosphor protection layer, the phosphor protection layer (i) having an ultraviolet ray transmittance rate of 80% or higher, and (ii) having a function of inhibiting one or more of elements included in the one or more phosphor layers that are to degrade discharge properties of the dielectric protection layer from dispersing into the discharge space.

In the PDP described in (42), at least part of the area of the surfaces of the phosphor layers facing the discharge space is covered with the phosphor protection layer; therefore, in the covered area, the aforementioned elements (such as Group IV elements, transition metal, alkali metal, or alkaline earth metal (except for Mg)) do not disperse into the discharge space due to the discharges generated during the driving of the panel. Accordingly, with the PDP described in (42), it is possible to maintain the discharge characteristics (i.e. the impedance) of the dielectric protection layer that have been set at the stage of designing, even after the panel has been driven for a long period of time. Thus, it is possible to inhibit the image quality from degrading due to occurrence of black noise that may be caused when the driving has lasted for a long period of time.

In addition, the phosphor protection layer in the PDP described in (42) is formed so as to keep the ultraviolet ray transmittance rate at 80% or higher; therefore, the percentage for the ultraviolet ray generated in the discharge spaces to be shielded by the phosphor protection layer is low. Thus, although the luminance of the panel at the initial stage of the driving is slightly lowered, the effect of inhibiting occurrence of black noise after the panel has been driven for a long period of time is large.

Thus, with the PDP described in (42), even after the driving of the panel has lasted for a long period of time, black noise occurrence is inhibited while the luminance of the whole panel being kept high, and superior image quality is maintained.

It should be noted that with the arrangements of the PDP according to the present invention, it is possible to achieve effects even if not all the phosphor layers for the three colors of red (R), green (G), and blue (B), contain such an element as Group IV element, transition metal, alkali metal, or alkaline earth metal (except for Mg). For example, in the case where a Group IV element such as Si is included only in the G phosphor layer, and no such element is included in the other phosphor layers, by having an arrangement wherein at least the surface of the G phosphor layer that faces the discharge space is covered with a phosphor protection layer, the element such as the Group IV element do not disperse into the discharge spaces due to the driving of the panel, as viewed throughout the panel as a whole. In addition, in such a PDP, the G phosphor layer contains such an element as the Group IV element, and the luminance is high at the initial stage of the driving, in the discharge spaces of all the colors of R, G, and B. Additionally, because the phosphor protection layer is formed, black noise occurrence is inhibited that may be caused when the driving of the panel has lasted for a long period of time. Consequently, with such a PDP, it is possible to maintain the high image quality that has been set at the time of designing, from the initial stage of the driving through after the panel has been driven for a long period of time.

(43) The present invention also provides the PDP as described in (42) wherein any of the phosphor layers whose surface facing the discharge space is covered by the phosphor protection layer contains one or more of (i) at least one Group IV element of no less than 1,000 mass ppm (ii) at least one transition metal of no less than 30,000 mass ppm, and (iii) at least one alkali metal or alkaline earthmetal other than Mg of no less than 60,000 mass ppm. It is further desirable to have this arrangement wherein the phosphor layer that contains the aforementioned element at a high ratio is covered with the phosphor protection layer, in order to achieve both improvement of the luminance of the panel and inhibition of black noise occurrence.

(44) The present invention also provides the PDP as described in (42) wherein the phosphor protection layer covers the surfaces of all the phosphor layers.

(45) The present invention also provides the PDP as described in (42) wherein a main component of the phosphor protection layer is $MgF_2$.

(46) The present invention also provides the PDP as described in (42) wherein the phosphor protection layer has a lamination structure in which a first layer whose main component is MgO and a second layer whose main component is $MgF_2$ are laminated, and the first layer faces the discharge space.

With this arrangement as with the PDP described in (46), wherein the first layer including MgO is disposed on the discharge space side and the second layer including $MgF_2$ is disposed on the phosphor layer side, it is possible to improve the sputtering resistance characteristics of the phosphor protection layer itself while discharges are generated, and to arrange the total thickness of the layer to be thin.

(47) The present invention also provides the PDP as described in (46) wherein a thickness of the first layer is smaller than a thickness of the second layer.

It is desirable to have this arrangement wherein the thickness of the first layer is smaller than that of the second layer, since it is possible to achieve both high transmittance rate of the phosphor protection layer and maintenance of the sputtering resistance characteristics.

BEST MODE FOR CARRYING OUT THE INVENTION

First Embodiment 1-1 Configuration of the PDP

Figure 1:
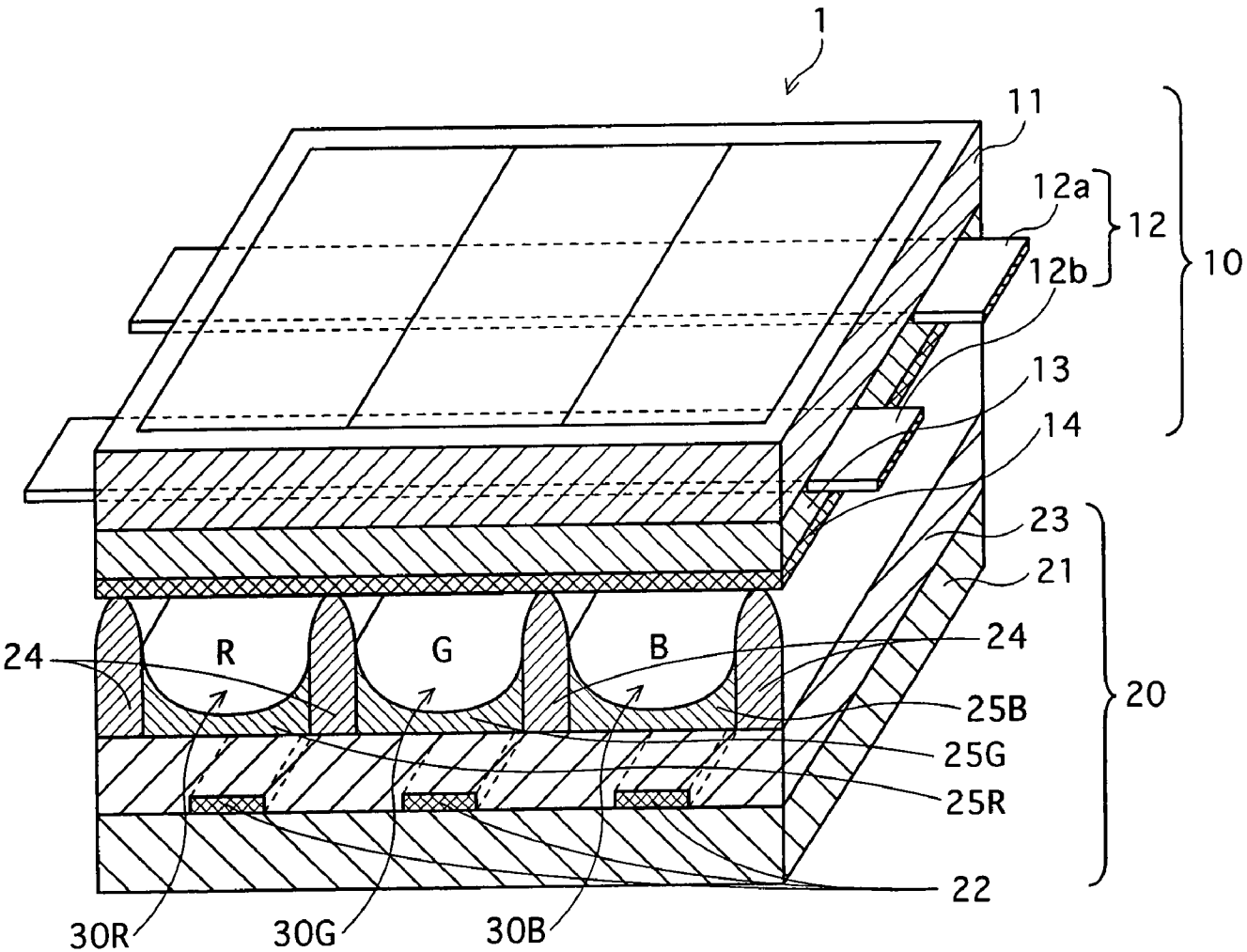
FIG. 1 is a perspective view (partially, cross sectional view) of the principal part of the PDP 1 according to the first embodiment.

The following describes the configuration of the AC-type PDP (hereafter, simply referred to as "PDP") 1, according to an embodiment of the present invention, with reference to FIG. 1. FIG. 1 is a principal-part perspective view that selectively shows the principal part of the PDP 1. Here, the PDP 1 is a panel that has specifications applicable to a 40-inch class VGA; however, the present invention is not limited to this example.

As shown in FIG. 1, the PDP 1 comprises a front panel 10 and a back panel 20 that are disposed to oppose each other with a space therebetween.

On the front glass substrate 11, which serves as a substrate in the front panel 10, display electrodes 12 (scan electrodes 12 a and sustain electrodes 12*b*) are provided in stripes. On the surface of the front glass substrate 11 on which the display electrodes 12 are provided, a dielectric glass layer 13 is disposed so as to cover the whole surface, and further, a dielectric protection layer 14 is provided over it.

It should be noted that, although it is not shown in the drawing, each display electrode 12 has a structure in which a bus line of Ag fine wire is laminated on top of a lower layer made up of a transparent electrode film (e.g. ITO).

On the other hand, on the back glass substrate 21, which serves as a substrate in the back panel 20, address electrodes 22 are provided in stripes. On the surface of the back glass substrate 21 on which the address electrodes 22 are provided, a dielectric glass layer 23 is disposed so as to cover the whole surface. Further, on the dielectric glass layer 23, barrier ribs 24 are projectingly provided so that each barrier rib is situated in a gap between two address electrodes 22 that are positioned adjacent to each other. On the walls of each of the grooves defined by the dielectric glass layer 23 and two adjacent ones of the barrier ribs 24, one of the phosphor layers 25R, 25G, and 25B for red (R), green (G), and blue (B) is formed, in such a manner that different grooves have different colors.

Each of the phosphor layers 25R, 25G, and 25B contains, as the phosphor member being the principal component thereof, a substance as described below that contains, in its composition, Si which is a Group IV element.

Red (R): $Y_2SiO_5$:Eu

Green (G): $Zn_2SiO_4$:Mn

Blue (B): $Y_2SiO_3$:Ce

The front panel 10 and the back panel 20 are disposed in such a manner that the dielectric protection layer 14 opposes the phosphor layers 25R, 25G, and 25B and also that the display electrodes 12 intersect the address electrodes 22. The perimeter areas are sealed together with glass frit.

Discharge gas that includes inert gas components such as helium (He), xenon (Xe), neon (Ne), and the like is enclosed at a predetermined pressure (for example 53.2 kPa to 79.8 kPa) in the discharge spaces 30R, 30G, and 30B that are defined by the dielectric protection layer 14, the barrier ribs 24, and the phosphor layers 25R, 25G, and 25B.

Each of the discharge spaces 30R, 30G, and 30B is provided between two barrier ribs 24 positioned adjacent to each other. The area at which a pair made up of a scan electrode 12*a* and a sustain electrode 12*b* intersects an address electrode 22 with a discharge space 30R, 30G, or 30B interposed therebetween corresponds to a cell for image display. Three cells for R, G, and B that are positioned adjacent to one another constitute one pixel. In the PDP 1 according to the present embodiment, the cell pitch is 1080 μm in the x direction and 360 μm in the y direction. Three cells for R, G, and B that are positioned adjacent to one another constitute one pixel (for example, 1080 μm×1080 μm).

1-2. The Manufacturing Method of the PDP 1

The following describes the manufacturing method of the PDP 1 mentioned above.

The Manufacture of the Front Panel 10

Throughout one of the main surfaces of the front glass substrate 11 (for example, approximately 2.6 mm in thickness) made of soda lime glass, an ITO film (a transparent conductive material including indium oxide and tin oxide) having thickness of approximately 0.12 μm is formed with the use of a sputtering method. The film is formed into stripes with widths of 150 μm (the intervals are each 0.05 mm) with the use of a photolithography method so as to form an electrode lower layer (not shown in the drawing). Subsequently, after a film is formed by applying a photosensitive silver (Ag) paste thereon all over, Ag bus lines (not shown in the drawing) are formed in stripes with widths of 30 μm over the aforementioned electrode lower layer, with the use of a photolithography method. Then, the Ag bus lines are baked at a temperature of approximately 550 degrees centigrade so as to form the display electrodes 12.

Next, throughout the surface of the front glass substrate 11 on which the display electrodes 12 are formed, a paste is applied in which dielectric glass powder (lead oxide-based or bismuth oxide-based) whose softening point is within the range from 550 degrees centigrade to 600 degrees centigrade is mixed with an organic binder including butyl carbitol acetate or the like. After getting dry, the paste is baked at a temperature within the range from 550 degrees centigrade to 650 degrees centigrade so as to form the dielectric glass layer 13.

Next, the dielectric protection layer 14 having thickness of 700 nm is formed on the surface of the dielectric glass layer 13, with the use of an EB evaporation method. More specifically, pellets of MgO (the average particle diameter is 3 mm to 5 mm; the purity is no less than 99.95%) are used as the evaporation source, and with the use of a reactive EB evaporation method which uses a piercing gun as a heating source, the dielectric protection layer 14 is formed under the following conditions: Degree of vacuum: $6.5\times10^{-3}$ Pa; Amount of oxygen introduced: 10 sccm; Oxygen partial pressure: 90% or higher; Rate: 2 nm/s; and Substrate temperature: 150 degrees centigrade. The ingredient of the dielectric protection layer 14 may be selected from the group consisting of MgO, $MgF_2$, and MgAlO.

In order to form the dielectric protection layer 14, it is acceptable to use a CVD (chemical-vapor deposition) method or the like, instead of the aforementioned method.

The Manufacture of the Back Panel 20

Throughout one of the main surfaces of the back glass substrate 21 (for example, approximately 2.6 mm in thickness) made of soda lime glass, after a film is formed by applying a photosensitive silver (Ag) paste (approximately 5 μm in thickness), the film is formed into stripes with the use of a photolithography method and baked at a temperature of approximately 550 degrees centigrade, so as to form the address electrodes 22.

Next, on the surface of the back glass substrate 21 on which the address electrodes 22 are formed, the dielectric glass layer 23 is formed with the use of the same method as the dielectric glass layer 13 formed on the front panel 10. It should be noted that it is acceptable that when the dielectric glass layer 23 is formed on the back panel 20, titanium oxide ($TiO_2$) may be contained in the layer.

Subsequently, a glass paste is prepared with a lead-based glass material, and with the use of a screen printing method the glass paste is applied onto the dielectric glass layer 23 in stripes in multiple processes and baked so as to form the barrier ribs 24. The barrier ribs 24 are formed at positions that are between two adjacent address electrodes 22. The height of each barrier ribs is eventually 60 μm to 100 μm. It should be noted that in the present embodiment it is desirable if the lead-based glass material used to form the barrier ribs 24 contains Si components, because the effect of inhibiting the increase in the impedance of the dielectric protection layer 14 becomes higher. In addition, it is acceptable that Si components are contained in the glass as its composition or added to the ingredients of the glass.

On the back glass substrate 20 on which the barrier ribs 24 are formed, grooves are defined by two adjacent barrier ribs 24 and the dielectric glass layer 23. Phosphor inks that each include a phosphor member for one of the colors are applied into the grooves in such a manner that different grooves have different colors.

Each phosphor ink is prepared by putting one of the aforementioned phosphor members into a server so that it amounts to 50 mass % and adding ethyl cellulose by 0.1 mass % and a solvent (α-terpineol) by 49 mass %, and further stirring and mixing them together with a sand mill so that the viscosity is adjusted to $15\times10^{-3}$ Pa·s. The phosphor inks manufactured in this way are poured into containers, each for one of the colors, that are connected to pumps, and injected and applied, with the pump pressure, onto the walls of the grooves between the barrier ribs 24 from the nozzles having a diameter of 60 μm.

The nozzles are moved along the lengthwise direction of the barrier ribs 24 so that the phosphor inks are applied in stripes.

After all the gaps between the barrier ribs 24 have a phosphor ink for one of the colors applied, the back glass substrate 21 is baked for about 10 minutes at a temperature of approximately 500 degrees centigrade so that the phosphor layers 25R, 25G, and 25B are formed. The phosphor members included in the phosphor layers 25R, 25G, and 25B all contain Si and have the compositions as described above.

Completion of the PDP 1

The front panel 10 and the back panel 20 manufactured as above are pasted together using sealing glass. Subsequently, the insides of the discharge spaces 30R, 30G, and 30B are evacuated so that they reach the level of high vacuum ($1.0\times 10^{-4}$ Pa), and discharge gas such as a Ne—Xe gas mixture or a He—Ne—Xe—Ar gas mixture is enclosed at a predetermined pressure (for example, 53.2 kPa to 79.8 kPa).

Thus, the PDP 1 is completed.

1-3. Basic Operation of the PDP 1

The PDP 1 configured as above is driven by a driving unit, which is not shown in the drawing, that supplies electricity to the display electrodes 12 and the address electrodes 22. The driving unit controls the light emission of each cell with binary values for on and off. In order to express different levels of gray, each of the time-series frames "Fs" that represent an image inputted from the outside is divided into, for example, six sub-frames. The number of light emissions from sustain discharges in each sub-frame is set while the relative ratio among the luminances of the sub-frames are weighed so as to be 1:2:4:8:16:32, for instance. Within each sub-frame, a reset period, an address period, and a sustain period are allocated.

During a reset period, wall charges are erased (initialized) throughout the screen, in order to avoid the influence from the previous lighting in the cells (to avoid the influence from the accumulated wall charges). A reset pulse of positive polarity that exceeds the plane-discharge start voltage is applied to all of the display electrodes 12. Together with this, a pulse of positive polarity is applied to all of the address electrodes 22 in order to prevent the back panel 20 from being electrified and having ion bombardment. During the leading and trailing edges of the applied pulse, a strong plane discharge is generated in all of the cells, and most of the wall charges are erased in all of the discharge cells so that the whole screen uniformly comes into an unelectrified state.

During an address period, addressing (setting of turning the light on or off) of selected cells is performed based on image signals divided for each sub-frame. The scan electrodes 12*a* are biased so as to have a positive electrical potential with respect to the ground potential. All of the sustain electrodes 12*b* are biased so as to have a negative electrical potential. While they are in that state, the lines are sequentially selected, one line at a time, starting with the line in the most upper part of the panel (a row of discharge cells that correspond to a pair of display electrodes), so that a scan pulse of negative polarity is applied to the corresponding sustain electrode 12*b*. In addition, an address pulse of positive polarity is applied to the address electrode 22 that corresponds to the discharge cell to be turned on. During the addressing, no discharge is generated, but wall charges are accumulated only in the discharge cells to be turned on.

During a sustain period, the lighting state that has been set is sustained so that the luminance according to the level in the grayscale is maintained. In order to prevent unnecessary discharges, all of the address electrodes 22 are biased so as to have an electrical potential of positive polarity, and a sustain pulse of positive polarity is applied to all of the sustain electrodes 12*b*. Subsequently, a sustain pulse is applied to the scan electrodes 12*a* and the sustain electrodes 12*b* alternately, so that discharges are repeated for a predetermined period of time.

It should be noted that the length of a reset period and the length of an address period are regular regardless of the weights on the luminances; however, the larger the weight on the luminance is, the longer a sustain period is. In other words, the lengths of the display periods for the sub-frames are mutually different.

As described above, in the PDP 1, with combinations in units of sub-frames for each of the colors of R, G, and B, display is achieved with multi-colors and multi-levels in the grayscale.

1-4. Advantageous Features of the PDP 1

In the PDP 1 according to the first embodiment with the configuration above, since a phosphor member containing in its composition Si which is a Group IV element is used in each of the phosphor layers 25R, 25G, and 25B for the colors of R, G, and B, the Group IV element (the element of Si) is contained in each of the phosphor layers 25R, 25G, and 25B, so that the ratio is within the range between 100 mass ppm and 50,000 mass ppm inclusive, and all the phosphor layers 25R, 25G, and 25B have the same ratio. With this inventive arrangement, it is possible to achieve an effect of having a uniform direction in which the impedance of the dielectric protection layer 14 changes over the course of time. More specifically, adding a Group IV element to all of the phosphor layers 25R, 25G, and 25B makes the impedance of the dielectric protection layer 14 rise by a same degree over the course of time in discharge cells that correspond to all of the colors or R, G, and B. With this arrangement according to the first embodiment, it is possible to suppress variations that may be observed in the chronological changes in the impedance of the dielectric protection layer 14 corresponding to all the colors of R, G, and B, and also, it is possible to make the directional characteristics of the changes uniform for all the three colors; therefore, it is possible to inhibit occurrence of black noise by chronologically adopting a driving method that suits the changes of the impedance.

As explained above, with the PDP 1, by projecting the degree of changes in the impedance of the dielectric protection layer 14 that corresponds to the discharge cells for the colors of R, G, and B, and by setting, on the driving circuit side, the voltage set margin a little higher in advance when the PDP 1 is manufactured or by chronologically changing the balance between the applied voltage during the address period and the applied voltage during the sustain period, it is possible to take extremely effective measures for maintaining good image display performance by, for example, reducing occurrence of black noise.

It should be noted that the present invention has an arrangement wherein Si exists in the composition of the phosphor member; however, alternatively, it is acceptable to add another Group IV element besides Si, a transition metal, an alkali metal, or an alkaline earthmetal (except for Mg). It is also acceptable to add, when the dielectric protection layer 14 is formed, such an element to the layer, instead of putting the element in the phosphor members themselves. With the use of a transition metal, it is possible to achieve the effect of preventing the impedance of the dielectric protection layer 14 from lowering. As for these variations, description is provided in the Embodiment Examples 1 through 4 below.

1-5. Confirmation Experiments

For the first embodiment and other embodiments of the present invention, Embodiment Examples and Comparison Examples (PDPs and samples for measurement) were manufactured, and confirmation experiments were conducted.

THE EMBODIMENT EXAMPLE 1

The following describes the manufacturing method of the PDP for the Embodiment Example 1.

Among the phosphor members for R, G, and B, to be used in the phosphor layers, a material that contains Si as its base was selected for each of the red phosphor member and the blue phosphor member.

PHOSPHOR MEMBERS FOR EACH COLOR IN THE EMBODIMENT EXAMPLE 1

Red phosphor member: $Y_2SiO_5$:Eu
Green phosphor member: $Zn_2SiO_4$:Mn
Blue phosphor member: $Y_2SiO_3$:Ce

THE COMPARISON EXAMPLE 1

PDPs as the comparison examples were also manufactured to make comparison with. As the comparison examples, the following combinations of phosphor materials were used.

PHOSPHOR MEMBERS FOR EACH COLOR IN THE COMPARISON EXAMPLE 1

Red phosphor member: $Y_2O_3$:$Eu^{3+}$
Green phosphor member: $Zn_2SiO_4$:Mn
Blue phosphor member: $BaMgAl_{10}O_{17}$:$Eu^{2+}$ Other manufacturing steps are the same as those in the first embodiment. Particularly, MgO that constitutes the dielectric protection layer is formed using the aforementioned method in which impurities are prevented from mixing in (an EB evaporation method in a chamber).

In order to examine the performance of the PDP of the Embodiment Example 1, samples for measuring the impedance and samples for conducting long-period degradation tests that each have the same performance characteristics as this PDP were manufactured.

Impedance Measuring Apparatus and Accelerated Degradation Testing Apparatus

Firstly, description is provided on the impedance measuring apparatus and the accelerated degradation testing apparatus that were used in the experiments, with reference to FIGS. 2 and 3.

Figure 2A:
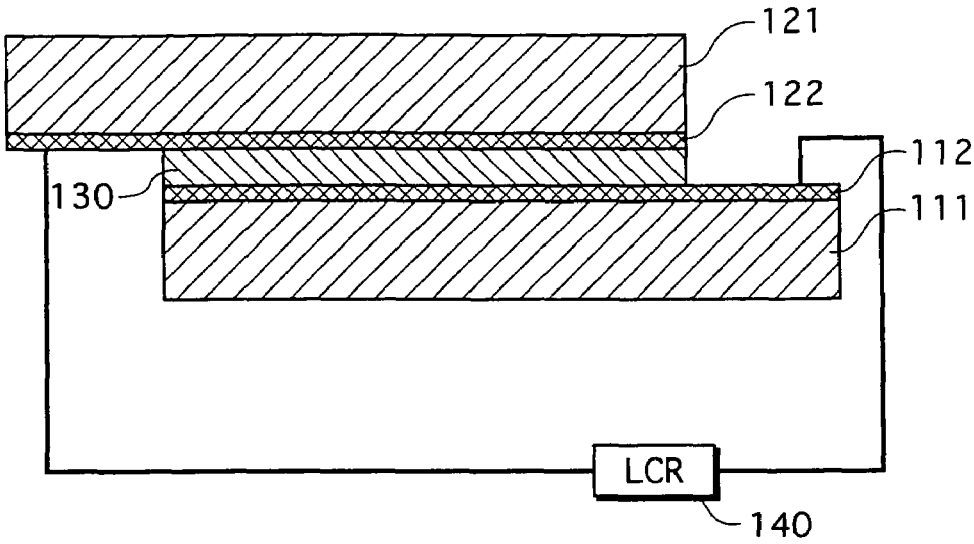
FIG. 2 is a schematic drawing that shows the configuration of the apparatus that is for measuring the impedance of the dielectric protection layer and is used in confirmation tests.

As shown in FIG. 2A, the impedance measuring apparatus includes the glass substrate 111 (50 mm×40 mm) on the surface of which the electrodes 112 made of ITO are formed and the glass substrate 121 (50 mm×40 mm) on the surface of which, likewise, the electrode 122 made of ITO is formed. The glass substrate 111 and the glass substrate 121 are disposed so that the electrodes 112 and the electrode 122 oppose each other with a space of 0.7 μm interposed therebetween. Between the electrodes 112 and the electrode 122, a dielectric protection layer 130 (having thickness of 700 nm) which is a target of the measuring is disposed.

Figure 2B:
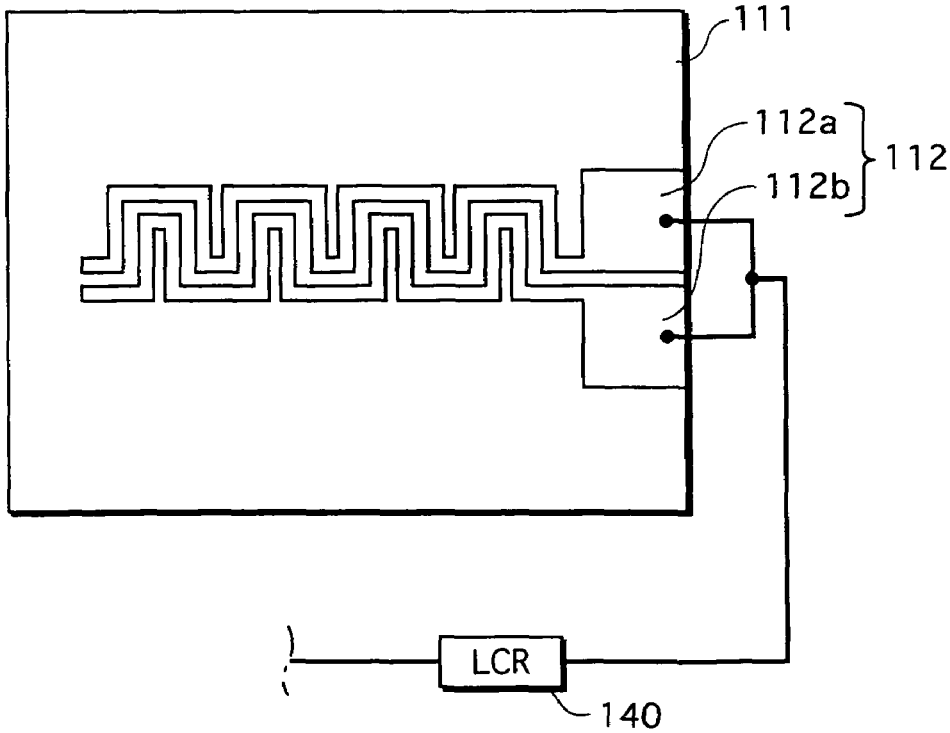

As shown in FIG. 2B, the electrodes 112 are made up of an electrode 112*a* and an electrode 112*b* both of which are shaped in a meandering pattern. The gap between the electrode 112*a* and the electrode 112*b* is set so as to be 50 μm, to coincide the one in the PDP 1. On one end of each of the electrode 112*a* and the electrode 112*b*, a land having a rectangular shape is formed. A lead wire connected with a LCR meter 140 is connected to the land.

To the LCR meter 140, a lead wire extending from the electrode 122 formed throughout the surface of the glass substrate 121 is also connected.

The measurement of impedance was conducted under a condition that the dielectric protection layer 130 is sandwiched between the glass substrate 111 and the glass substrate 121 with a pressure of 700 kPa; the applied voltage was 1V; and the frequency was 100 Hz.

The impedance was measured before and after an accelerated degradation test, which is to be described later. As a result of study conducted by the inventors of the present invention while taking occurrence of black noise in PDPs into consideration, the tolerance range of impedance is from 220 kΩ/$cm^2$ to 340 kΩ/$cm^2$ inclusive.

Figure 3A:
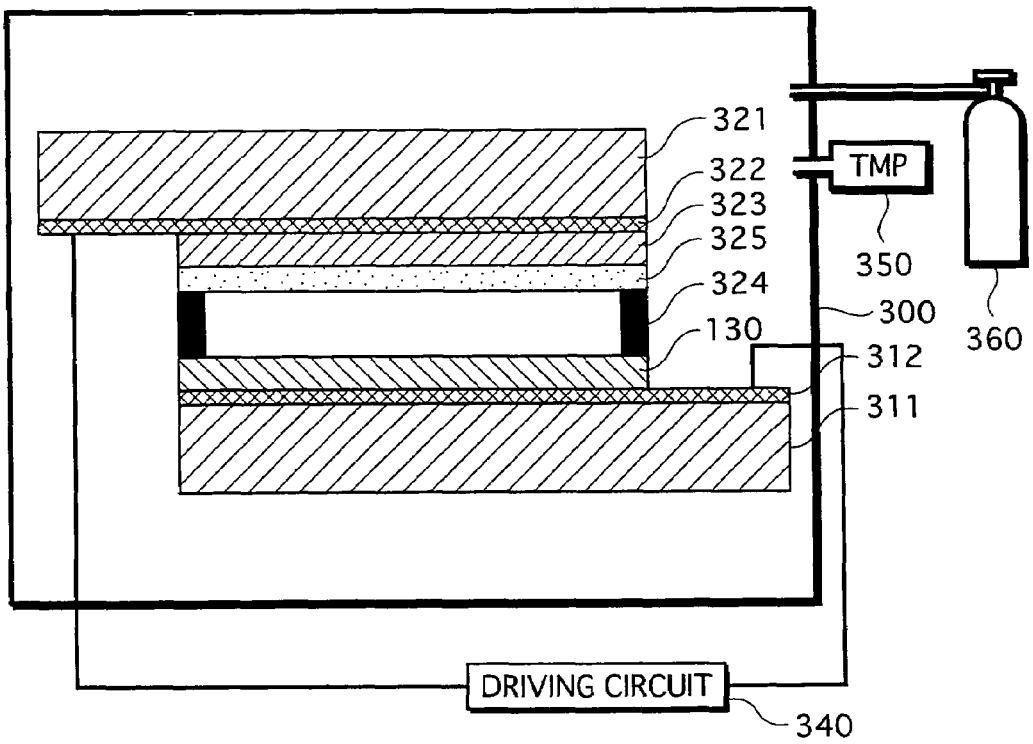
FIG. 3 is a schematic drawing that shows the configuration of the accelerated degradation testing apparatus used in confirmation tests.
Figure 3B:
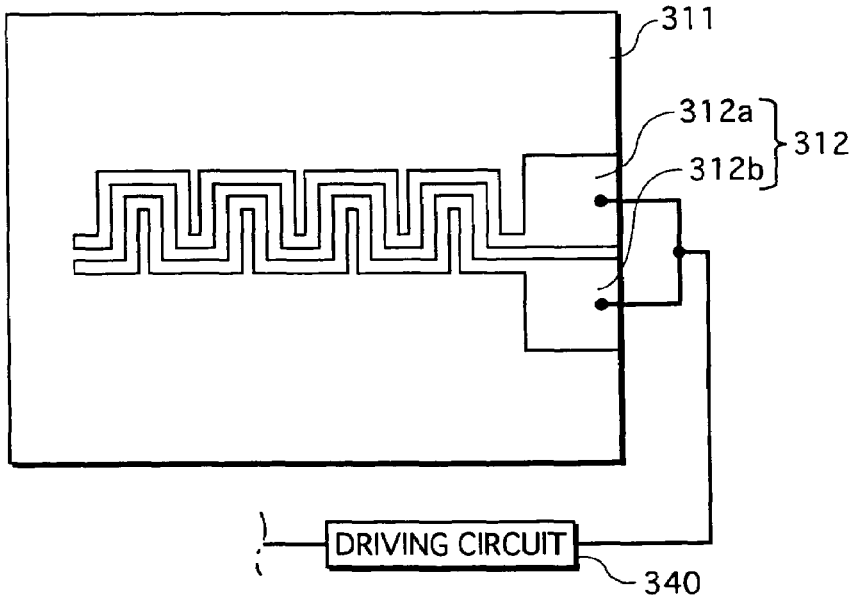

Next, as shown in FIG. 3A, a glass substrate 311, which is identical to the glass substrate 111 used in the impedance measuring apparatus described above, is used in the accelerated degradation testing apparatus. In other words, electrodes 312 which are made up of electrodes 312*a* and 312*b* are formed on the surface of the glass substrate 311, as shown in FIG. 3B.

The electrode 322 made of ITO is formed throughout the surface of the glass substrate 321 (50 mm×40 mm), and a dielectric glass layer 323 is formed so as to cover them. Further, on the surface thereof, a phosphor layer 325 which has characteristics to be described later is formed. In addition, on the surface of the phosphor layer 325, spacers (barrier ribs) 324 are formed, in correspondence with the cell size, 0.36 mm, of the PDP 1.

In the chamber 300, the glass substrate 311 and the substrate 321 are stacked together while the dielectric protection layer 130 is sandwiched therebetween, and weight is added. After the inside of the chamber 300 is made to be high vacuum (approximately $1.0\times10^{-4}$) with the use of TMP 350, the chamber 300 is filled with discharge gas having predetermined composition provided from the gas cylinder 360.

The electrodes 312 and 322 are connected to the driving circuit 340, and pulses that are the same as the ones in the PDP 1 are applied to the electrodes 312 and 322.

With the above arrangement, pulses with frequency being five times higher than the driving frequency normally used in a PDP were sequentially applied from the driving circuit 340, so as to conduct an accelerated degradation test. The image quality of the panel was evaluated after the initial stage of driving and after the degradation test. In order to evaluate the image quality, the standard shown in the Table 1 below was applied.

TABLE 1

| Evaluation Level | Level of Black Noise Occurrence | Judgment |
|---|---|---|
| 5 | No black noise occurred | ○ |
| 4 | Black noise occurred in a small number of cells intermittently | Δ |
| 3 | Black noise occurred in a small number of cells regularly | X |
| 2 | Black noise occurred in most of the cells in one line regularly | |

TABLE 1-continued

| Evaluation Level | Level of Black Noise Occurrence | Judgment |
|---|---|---|
| 1 | Black noise occurred in most of the cells in more than one line regularly | |

As shown in the Table 1, the image quality is evaluated with a 5-level grading system. A level of a higher number indicates better image quality. PDPs with evaluation levels of 4 and 5 are practically at the levels allowed to be shipped as products.

Evaluation Results

The results of the measurement and the evaluation described above are shown in the Table 2 and Table 3, along with some data for the Embodiment Examples 2 through 4 to be described later. It should be noted that the impedance of the dielectric protection layer in the Table 3 is the average of values taken from five samples. The practical tolerance range of impedance of a dielectric protection layer used in a PDP is the range of 30 kΩ/cm$^2$ below and above a suppositional impedance conjectured from occurrence of defects in mass production and design conditions. For example, in a case where the panel is driven with a suppositional impedance of 280 kΩ/cm$^2$, no black noise occurs if the changes in the impedance of a dielectric protection layer that corresponds to the phosphor layers for the three colors is within the range between 250 Ω/cm$^2$ and 310 Ω/cm$^2$ inclusive. Performance of PDPs were evaluated with the judgment standard based on such values.

The "suppositional impedance" mentioned here is ideally calculated by dividing the sum of the maximum value before a degradation test and a minimum value after the degradation test by two, the maximum value and the minimum value being taken from among impedance values of the dielectric protection layer that corresponds to the phosphor layers for R, G, and B.

TABLE 2

| | Manufacturing Conditions | | Image Quality (Level of black noise) | |
|---|---|---|---|---|
| | Phosphor Members | Dielectric Protection Layer | Initial Stage of Driving | After Degradation Test |
| Comparison Example 1 | Only G has composition containing Si | No addition | 4 | 3 |
| Embodiment Example 1 | RGB all have composition containing Si | No addition | 4 | 3* |
| Embodiment Example 2 | A small amount of Si is added to each of RGB (1,000 ppm) | No addition | 4 | 5 |
| Embodiment Example 3 | A small amount of Si is added to each of RGB (1,000 ppm) | A small amount of Si is added (700 ppm) | 5 | 4* |
| Embodiment Example 4 | A small amount of Ni is added to each of RGB (1,000 ppm) | A small amount of Si is added (1,000 ppm) | 5 | 5 |

The symbol * means that the level was changed to 5 after adjustment of the driving

TABLE 3

| | Manufacturing Conditions | | Impedance (kΩ/cm$^2$) | |
|---|---|---|---|---|
| | Phosphor Layer | Dielectric Protection Layer | Initial Stage of Driving | After Degradation Test |
| Comparison Example 1 | R phosphor member | No addition | 310 | 315 |
| | G phosphor member (composition containing Si) | No addition | 315 | 225 |
| | B phosphor member | No addition | 315 | 310 |
| Embodiment Example 1 | R phosphor member (composition containing Si) | No addition | 310 | 230 |
| | G phosphor member (composition containing Si) | No addition | 315 | 225 |
| | B phosphor member (composition containing Si) | No addition | 310 | 230 |
| Embodiment Example 2 | A small amount of Si is added to R phosphor layer (1,000 ppm) | No addition | 310 | 275 |
| | A small amount of Si is added to G phosphor layer (1,000 ppm) | No addition | 315 | 270 |
| | A small amount of Si is added to B phosphor layer (1,000 ppm) | No addition | 310 | 270 |
| Embodiment Example 3 | A small amount of Si is added to R phosphor layer (1,000 ppm) | A small amount of Si is added (700 ppm) | 285 | 240 |
| | A small amount of Si is added to G phosphor layer (1,000 ppm) | A small amount of Si is added (700 ppm) | 280 | 240 |
| | A small amount of Si is added to B phosphor layer (1,000 ppm) | A small amount of Si is added (700 ppm) | 280 | 240 |

TABLE 3-continued

| | Manufacturing Conditions | | Impedance (kΩ/cm$^2$) | |
|---|---|---|---|---|
| | Phosphor Layer | Dielectric Protection Layer | Initial Stage of Driving | After Degradation Test |
| Embodiment Example 4 | A small amount of Ni is added to R phosphor layer (1,000 ppm) | A small amount of Si is added (1,000 ppm) | 265 | 295 |
| | A small amount of Ni is added to G phosphor layer (1,000 ppm) | A small amount of Si is added (1,000 ppm) | 260 | 300 |
| | A small amount of Ni is added to B phosphor layer (1,000 ppm) | A small amount of Si is added (1,000 ppm) | 260 | 300 |

Observations

From the data shown in the Table 2, regarding both the Comparison Example 1 in which only the green phosphor member has composition containing Si and the Embodiment Example 1 in which the phosphor members for all of R, G, and B have composition containing Si, the results of the image quality evaluation for the initial stage of the driving and after the degradation test were almost the same. Both exhibited good results.

On the other hand, however, the results of impedance measurement in the Table 3 show that in the case of the Comparison Example 1, variations were observed in the impedance of the dielectric protection layer corresponding to the phosphor members for the different colors. The suppositional impedance for the Comparison Example 1 is considered to approximate to 270 kΩ/cm$^2$. In reference to this suppositional impedance, the variations in the impedances of the Comparison Example 1 after the degradation test all exceed 30 kΩ/cm$^2$. As conjectured from this, the Comparison Example 1 eventually induces black noise and is lead to degradation of image quality.

In contrast to this, in the case of the Embodiment Example 1, the impedances of the dielectric protection layer corresponding to the phosphor members after the degradation test are substantially uniform. The variations in the impedances with respect to the suppositional impedance being 230 kΩ/cm$^2$ were no larger than 30 kΩ/cm$^2$, and it was observed that the driving was stable. As observed from the Table 2, with the simple driving adjustment of shortening the address period and the sustain period, the PDP of the Embodiment Example 1 has become less likely to have black noise occurrence, and the image quality evaluation level has also reached level 5. Conventional PDPs including the Comparison Example 1 has too a large difference between impedances of the dielectric protection layer corresponding to the cells in the phosphor layers for R and B and the dielectric protection layer corresponding to the cells in the phosphor layer for G; therefore, it is difficult to eliminate black noise with the influence from the driving method adjustment. When we make comparison after optimizing the driving method, the configuration of the Embodiment Example 1 has an effect of having a higher yield, when manufacturing variations are taken into consideration. The driving of PDPs can be defined with the range of suppositional impedance of the dielectric protection layer. A suppositional impedance value is normally 280 kΩ/cm$^2$; however, the suppositional impedance value may vary within the range between approximately 200 kΩ/cm$^2$ and 350 kΩ/cm$^2$ inclusive.

As shown with the Embodiment Example 1, even if the impedances of the dielectric protection layer corresponding to the colors or R, G, and B change a little, as long as the difference due to impedance changes among the colors is small, it is possible to maintain the image quality at Level 5 by adjusting the voltage value in the driving circuit. However, as with the Comparison Example 1, when the differences due to impedance changes among the colors are large, it is not possible to maintain high image quality. For example, as shown with the Embodiment Example 1, in a case where the impedances of the dielectric protection layer are 310 kΩ/cm$^2$ for all the colors of R, G, and B at the initial stage of the driving, and are all approximately 230 kΩ/cm$^2$ after the degradation test, it is possible to maintain the image quality by changing, during the driving period, the set value of the driving voltage in accordance with impedance changes. On the other hand, as shown with the Comparison Example 1, in a case where the impedances after a degradation test show a wide range of variations such as 315 kΩ/cm$^2$ for R, 225 kΩ/cm$^2$ for G, and 310 kΩ/cm$^2$ for B, there is no better way in actuality than setting a suppositional impedance value at around 270 kΩ/cm$^2$ which is the average of the largest and the smallest values. In such a case, the impedances of the dielectric protection layer corresponding to the phosphor layers of the three colors do not fall within the range of 30 kΩ/cm$^2$ below and above the suppositional impedance; consequently, the level of image quality is low.

THE EMBODIMENT EXAMPLE 2

The following describes the manufacturing method of the PDP for the Embodiment Example 2 of the present invention.

For the Embodiment Example 2, a phosphor member that does not contain Si in its chemical composition is used as the phosphor material, and instead, an Si compound is added to each phosphor layer separately.

Red phosphor member: $Y_2O_3:Eu^{3+}$

Green phosphor member: $BaAl_{12}O_{19}:Mn$

Blue phosphor member: $BaMgAl_{10}O_{17}:Eu^{2+}$

It should be noted that to express the composition of the green phosphor member, sometimes $Ba_{0.82}Al_{12}O_{18.82}:Mn$ or $Ba_{(1-x)}Al_{12}O_{(29-x)}:Mn$ may be used, but the substance is the same as above. In the present description, the expression $BaAl_{12}O_{19}:Mn$ is to be used.

In order to manufacture the phosphor layers, $SiO_2$ powder is mixed into a phosphor member of each of the colors at the ratio of 1,000 mass ppm, and the mixture is then baked, pulverized, and sieved. The decreasing amount of impedance after degradation tests changes depending on how much an Si compound, such as $SiO_2$, is mixed in. Actually, when the amount of the Si compound is within the range between 100 mass ppm and 10,000 mass ppm, the impedances fall within an appropriate range of suppositional impedance (no smaller than approximately 200 kΩ/cm$^2$ and no larger than 350 kΩ/cm$^2$). It should be noted that although it is theoretically possible to make the mix-in ratio of the Si compound lower than 100 mass ppm, as a matter of practicality it is difficult, from the standpoint of mass production, to add with accuracy an Si compound that is in a smaller amount than 100 mass ppm.

Further, it is possible to achieve the same effect by adding another kind of Group IV element instead of Si. For the actual manufacturing process, a Ge compound, or more specifically, $GeO_2$ would be easily available and desirable.

After an Si compound is added, the phosphor layers can be manufactured in the same manner as in the first embodiment. For samples for measuring impedance and samples for degradation tests, phosphor layers each for a single color were formed. As a whole, the manufacturing method of the samples and the testing methods are the same as described for the Embodiment Example 1. The data obtained is shown in the Tables 2 and 3.

Observations

As indicated in the Table 2, the results of the evaluation of PDP image quality showed that the Embodiment Example 2 in which an Si compound is added to the phosphor layers for all the three colors of R, G, and B has less black noise occurrence and higher image quality than the Comparison Example 1, after the degradation test. For the Embodiment Example 2, the suppositional impedance value can be set at around 270 kΩ/cm$^2$ and since the impedance values after the degradation tests were all at similar levels; therefore, it is possible to have good display performance by setting a suppositional impedance value. As if to back up this notion, the impedance evaluation results in the Table 3 show that, with the Embodiment Example 2 in which an Si compound is added to the phosphor layers of all the three colors of R, G, and B, the increase in the impedance of the dielectric protection layer after the degradation test is effectively suppressed so as to fall in a range of appropriate values.

EMBODIMENT EXAMPLE 3

The following describes the manufacturing method of the PDP for the Embodiment Example 3.

The characteristics of the Embodiment Example 3 lie in the configuration in which each of the phosphor layers of R, G, and B contains a small amount of Si (1,000 mass ppm), and the dielectric protection layer comprising MgO also contains Si.

The forming process of the dielectric protection layer is as follows:

As the evaporation source, pellets of MgO are mixed with pellets or powder of an Si Compound ($SiO_2$, SiO). In the present example, MgO pellets whose purity is 99.95% and that have the average particle diameter of 3 mm are mixed with 1,900 mass ppm of $SiO_2$ powder. The mixture is used as the evaporation source, and evaporation is performed with the use of the reactive EB evaporation method, using a piercing gun as a heating source. The condition at this time is as follows: Degree of vacuum in the chamber: $6.5\times10^{-3}$ Pa; Amount of oxygen introduced: 10 sccm; Oxygen partial pressure: 90% or higher; Layer forming rate: 2.5 nm/s; Eventual thickness of layer: 700 nm; and Substrate temperature: 150 degrees centigrade. As a result, a protection layer with an Si concentration level of 700 mass ppm is obtained. It should be noted that it is possible to change the amount of Si included in the protection layer by adjusting the amount of $SiO_2$ mixed with the MgO pellets.

As for the evaporation source, it is possible to use a sintered material obtained from the mixture of MgO and an Si compound. Further, it is possible to form a dielectric protection layer comprising MgO and containing Si by performing sputtering with the aforementioned sintered material used as the target. Moreover, it is possible to form a dielectric protection layer comprising MgO and containing Ni, with the use of a method that uses a sintered material of the mixture of pellets or powder of Mgo and an Ni compound as the evaporation source.

The amount of Si included in the dielectric protection layer in the Embodiment Example 3 was measured with an SIMS (Secondary Ion Mass Spectrometry) method.

The other processes are performed in the same manner as the first embodiment. Samples for measuring impedance and samples for degradation tests were manufactured in the same manner as the Embodiment Example 1, except that phosphor layers each for a single color and dielectric glass layers containing Si were formed. The evaluations of PDP image quality and impedances based on the test results data and the degradation tests were performed in the same manner as the Embodiment Example 1 described above. The data are shown in the Tables 2 and 3.

Observations

Firstly, the Table 2 above indicates that the Embodiment Example 3 in which a small amount of Si component is mixed into each of the phosphor members of all R, G, and B and also exists in the dielectric protection layer with a concentration level of 700 mass ppm showed better image quality than the Comparison Example 1 at the initial stage of the driving and maintained the image quality at the level 4 even after the degradation test. With an arrangement in which the lengths of the address period and the sustain period are shortened, a PDP having the configuration of the Embodiment Example 3 had no black noise occurrence, and had the image quality evaluation at the level 5, which is the highest level, both at the initial stage of the driving and after the degradation test. As additional information, it was possible to set the suppositional impedance value for the Embodiment Example 3 at 260 kΩ/cm$^2$, and no variations were observed among the impedance values.

Secondly, as observed from the Table 3, the Embodiment Example 3 in which a small amount of Si is mixed into each of the phosphor members of all R, G, and B, and also exists in the dielectric protection layer with a concentration level of 700 mass ppm showed that impedances slightly decreased after the degradation tests, but the decrease amount was small, and the impedances were uniform for all of R, G, and B and were stable. Consequently, an effect of being able to design the driving process easily can be achieved. With the present Embodiment Example 3, Si is included in both the phosphor layers and the dielectric protection layer; however, we have confirmed from other experiments that it is possible to achieve the similar effect with other kinds of Group IV element besides Si.

THE EMBODIMENT EXAMPLE 4

The following describes the manufacturing method of the PDP for the Embodiment Example 4.

The characteristics of the Embodiment Example 4 lie in the configuration in which a small amount of Ni (1,000 mass ppm) is included each of the phosphor layers of R, G, and B, and also MgO in the dielectric protection layer contains Si.

The following phosphor members were used:

Red phosphor member: $Y_2O_3:Eu^{3+}$

Green phosphor member: $BaAl_{12}O_{19}:Mn$

Blue phosphor member: $BaMgAl_{10}O_{17}:Eu^{2+}$

An appropriate amount of Ni is put into each of the phosphor members above. More specifically, NiO powder is mixed into phosphor member powder for each color at the ratio of 1,000 mass ppm, so that the mixture is compounded, baked, pulverized, and sieved. It is easy to perform control when the NiO powder is added within the range between 100 mass ppm and 10,000 mass ppm. Thus, phosphor layers including Ni were prepared. It should be noted that it is acceptable to put a transition metal instead of Ni into each phosphor member. In such a case, a transition metal compound for example $WO_3$ may be used in the manufacturing process.

The dielectric protection layer was formed with a sputtering method. As the evaporation source, a sintered material was used in which Si compound powder (e.g. $SiO_2$) was mixed into MgO powder at the ratio of 2,700 mass ppm. Eventually, a dielectric protection layer whose Si concentration level was 1,000 mass ppm was formed. The amount of Si included was checked with the use of an SIMS method.

It should be noted that it is also acceptable to directly mix Si into MgO with a sputtering method.

As for the evaporation source of sputtering, it is acceptable to mix and sinter MgO and an Ni compound (NiO) so as to form a dielectric protection layer including Ni.

Tests for measuring impedances and degradation tests were performed in the same manner as with the Embodiment Example 1. The data is shown in the Tables 2 and 3.

Observations

As observed from the Table 2, in the case where a small amount of Ni is included in each of the phosphor layers of R, G, and B, and a small amount (1,000 mass ppm) of Si is included in the dielectric protection layer, it is possible to set the suppositional impedance value at 280 kΩ/cm$^2$, and the image quality is, for both at the initial stage of the driving and after the degradation test, at the level 5, which is the highest level.

As observed from the results of the impedance evaluations of the dielectric protection layer (MgO) in the Table 3, the Embodiment Example 4 showed that the impedance value at the initial stage of driving is slightly low, and the value gradually increases with the degradation test, but the increase amount is small, and that all of R, G, and B uniformly become stable at a value 20 kΩ/cm$^2$ higher than the suppositional impedance value. Consequently, an effect of being able to design the driving process easily can be achieved, with the Embodiment Example 4.

It should be noted that the Embodiment Example 4 has the configuration in which Ni is included in the phosphor layers, and Si is included in the dielectric protection layer; however, it has become clear from other experiments that the similar effect as above can be achieved with a configuration in which another kind of transition metal is included in each phosphor layer and another kind of Group IV element is included in the dielectric protection layer whose main component is MgO.

In addition, it is possible to have an effect of being able to freely set the impedance at the initial stage of driving and after a long period of driving and to optimize discharge properties so as to have image display with high quality with a configuration in which both a transition metal and a Group IV element such as Si are included either in the phosphor layers or in the dielectric protection layer. In such a case, it is desirable to arrange so that, in each phosphor layer, a transition metal is included, in terms of mass ratio, less than three times the amount of a Group IV element being included. On the other hand, it is desirable to arrange so that, in the dielectric protection layer, a transition metal is included, in terms of mass ratio, less than three times the amount of a Group IV element being included. The reason for these arrangements is that the effect of reducing impedance by a Group IV element is approximately three times stronger than the effect of increasing impedance by a transition metal. Since a Group IV element has an effect of stabilizing impedances (i.e. impedance does not vary largely with a change of the temperature), it is desirable to have an arrangement so that, in the dielectric protection layer, the amount of the Group IV element included is slightly larger than a third of the amount of the transition metal being included.

1-6. Other Information Related to the First Embodiment and the Embodiment Examples Above In the first embodiment and the embodiment examples above, description is provided mainly for the examples in which a Group IV element or a transition metal is used as a material to influence the changes in the impedances of the dielectric protection layer; however, the present invention is not limited to these examples, and the similar effect can be achieved, with the same method having the above configuration, with a configuration in which an alkali metal and/or an alkaline earth metal except for Mg is included in the dielectric protection layer and the phosphor layers, although these metals have rather smaller influence on impedances of the dielectric protection layer than Group IV elements and transition metals. When an alkali metal and/or an alkaline earth metal except for Mg is used, it is desirable to have an arrangement within the value range as described below:

(1) The total content ratio of alkali metal and/or alkaline earth metal (except for Mg) included in each of phosphor layers of R, G, and B, is within the range between 300 mass ppm and 120,000 mass ppm inclusive.

(2) The variation among the phosphor layers in terms of the content ratio of the element (i.e. alkali metal and/or alkaline earth metal except for Mg) included in each phosphor layer is no larger than 40,000 mass ppm.

(3) The one or more elements (i.e. alkali metal and/or alkaline earth metal except for Mg) included in the phosphor layers are in common with all the phosphor layers.

(4) It is sufficient as long as the one or more elements (i.e. alkali metal and/or alkaline earth metal except for Mg) are included in the phosphor layers. That is to say, the elements may be included in the composition of the phosphor member that constitutes each of the phosphor layers, or may be included in the other part of each phosphor layer besides the phosphor member.

Further, according to the present invention, in the case where a Group IV element such as Si is included in the phosphor layers in order to suppress the increase in the impedance of the dielectric protection layer, the degradation tests showed that the amount of Group IV element to be included so as to influence the impedance of the dielectric protection layer is equal to or larger than 100 mass ppm. However, if an excessive amount of Group IV element is included, the impedance value after a degradation test becomes lower than the appropriate range. Additionally, the amount of Group IV element to be added in order to properly control the impedances is equal to or smaller than 50,000 mass ppm. From these points, it is considered desirable to add a Group IV element to each phosphor layer within the range between 100 mass ppm and 50,000 mass ppm inclusive. It should be noted that these content ratios mentioned here are based on a premise that the Group IV element is contained at substantially the same ratio in all of the phosphor layers of R, G, and B.

More specifically, in the case where a Group IV element such as Si is included in each of the phosphor layers of R, G, and B, if the variation among the colors in terms of the amount the Group IV element added is larger than 20,000 mass ppm, the difference among the impedances of the dielectric protection layer corresponding to the phosphor layers of the different colors after the degradation test becomes large. Consequently, in order to suppress the occurrence of black noise after a long period of driving, it is desirable to have an arrangement wherein the variation among the phosphor layers of R, G, and B in terms of the content ratio of the Group IV element is within the range of values described above.

On the other hand, in the case where transition metal is included in each of the phosphor layers of R, G, and B, the amount to be added to influence the impedance of dielectric protection layer after the degradation test is 300 mass ppm; however, if an excessive amount of transition metal is included, the impedance value after a degradation test becomes higher than the appropriate range. Since the amount of transition metal to be added in order to properly control the impedances is equal to or smaller than 120,000 mass ppm, it is desirable to have an arrangement wherein the amount of transition metal to be added to each phosphor layer is within the range between 300 mass ppm and 120,000 mass ppm inclusive. At this time, it is desirable to arrange it so that the variation among the colors in terms of the amount of the transition metal added is no larger than 40,000 mass ppm.

In the case where a Group IV element such as Si is included in the dielectric protection layer comprising MgO, the degradation tests showed that the content ratio of Group IV element so as to influence the impedance of the dielectric protection layer is equal to or larger than 500 mass ppm. In the case where a transition metal such as Ni is included in the dielectric protection layer, the same kind of test showed that the content ratio of transition metal so as to influence the impedance is equal to or larger than 1,500 mass pm. It is understood from impedance measuring tests that the upper limit of the content ratio of each of these additional elements should preferably be approximately 6,000 mass ppm.

As explained so far, it is possible to make the differences small in the impedances of the dielectric protection layer corresponding to the phosphor layers of different colors after a degradation test, and to have image display with high quality by suppression of black noise occurrence, with an arrangement for a PDP wherein (i) a Group IV elements such as Si is contained in MgO included in the dielectric protection layer within the range between 500 mass ppm and 2,000 mass ppm inclusive and also (ii) a Group IV element is included in each of the phosphor layers of R, G, and B within the range between 100 mass ppm and 50,000 mass ppm inclusive.

Further, in the same manner as above, it is possible to make the differences small in the impedances of the dielectric protection layer corresponding to the phosphor layers of different colors after a degradation test, and to have image display with high quality by suppression of black noise occurrence, with an arrangement for a PDP wherein (i) a transition metal such as Mn, Fe, Co, or Ni is included in the dielectric protection layer within the range between 1,500 mass ppm and 6,000 mass ppm inclusive and also (ii) a transition metal is included in each of the phosphor layers of R, G, and B within the range between 300 mass ppm and 120,000 mass ppm inclusive. Here, as described above, it is possible to have an effect being the same as in the case where transition metal is included, by having an arrangement wherein alkali metal and/or alkaline earth metal (except for Mg) is included in the dielectric protection layer and in the phosphor layers. The desirable content ratio for these elements is similar or equal to the content ratio of transition metal. Also, with the case where alkali metal and/or alkaline earth metal (except for MgO) is included in the phosphor layers, it is desirable to arrange so that the variation among the colors in terms of the content ratio of the element is no larger than 40,000 mass ppm.

In the embodiment examples described above, the examples show that one kind of element being either a Group IV element or a transition metal is included in the phosphor layers and/or the dielectric protection layer; however, it is acceptable to have more than one kind of element included. Further, it is also acceptable to have both a Group IV element and transition metal included.

The Second Embodiment

2-1. Configuration of the PDP 2

The following describes the configuration of the PDP 2 according to the second embodiment.

The PDP 2 according to the present embodiment basically has a similar configuration to the PDP 1 of the first embodiment shown in FIG. 1. The main differences are the composition of the phosphor layers 25R, 25G, and 25B and the composition of the dielectric protection layer 14. Accordingly, the constituent elements of the PDP 2 have the same reference signs as those of the PDP 1, and the description of the configuration of the PDP 2 below mainly focuses on the differences from the PDP 1.

The PDP 2 comprises phosphor layers 25R, 25G, and 25B that are for colors or R, G, and B and whose main components are phosphor members with the compositions shown below:

Red phosphor member: $Y_2O_3$:Eu

Green phosphor member: a phosphor member manufactured with the method to be described later Blue phosphor member: $BaMgAl_{10}O_{17}$:$Mn^{2+}$ In the R phosphor layer 25R and the B phosphor layer 25B, within the parts besides the phosphor members, a Group IV element (e.g. Si) is included at the ratio within the range between 100 mass ppm and 5,000 mass ppm inclusive. In order to have the Group IV element included in the phosphor layers 25R and 25B, the method described above for the Embodiment Example 2 may be used.

Among the phosphor members corresponding to the three colors, the manufacturing method of the green phosphor member will be described later.

In addition, a Group IV element Si is included at the ratio of 1,500 mass ppm in the dielectric protection layer 14 provided on the front panel 10.

2-2. The Manufacturing Method of the PDP 2

The following describes the manufacturing method of the PDP 2, but since the manufacturing method is also basically similar to that of the first embodiment, the description mainly focuses on the differences.

The Manufacture of the Front Panel 10

The manufacturing process is the same as the one in the first embodiment up to where on one of the main surfaces of the front glass substrate 11, the display electrodes 12 and the dielectric glass layer 13 are formed. The difference lies in the method of forming the dielectric protection layer 14, which is described below.

A dielectric protection layer 14 having thickness of 700 nm, for example, is formed on the surface of the dielectric glass layer 13, with the use of a vacuum evaporation method that uses a mixture of magnesium oxide (MgO) and a silicon compound (for example, silicon dioxide or silicon monoxide) as the evaporation source. As a specific example of evaporation source, a mixture may be used in which silicon dioxide ($SiO_2$) is mixed, at the ratio of 1,000 mass ppm, with pellets of MgO (the average particle diameter is 3 mm to 5 mm; the purity is no less than 99.95%).

As a specific example of evaporation method, a reactive EB evaporation method which uses a piercing gun as a heating source may be used. At this time the layer is formed under the following conditions:

Degree of vacuum: $6.5\times10^{-3}$ Pa; Amount of oxygen introduced: 10 sccm; Oxygen partial pressure: 90% or higher; Rate: 2.5 nm/s; and Substrate temperature: 150 degrees centigrade. Thus, the dielectric protection layer 14 that contains Si at the ratio of 1,500 mass ppm is formed.

It should be noted that in order to form the dielectric protection layer 14, it is acceptable to use a CVD (chemical-vapor deposition) method or the like, instead of the EB evaporation method noted above. Further, it is acceptable to use, as the main ingredient of the dielectric protection layer 14, $MgF_2$, MgAlO, or the like, instead of MgO.

The Manufacture of the Back Panel 20

As for the back panel 20 also, the manufacturing process is the same as the one in the first embodiment up to where on one of the main surfaces of the backglass substrate 21, the address electrodes 22, the dielectric glass layer 23, and the barrier ribs 24 are formed. The difference lies in the method of forming the phosphor layers 25R, 25G, and 25B, which is described below.

Over the back glass substrate 21 on which the barrier ribs 24 are formed, grooves are formed between every two adjacent barrier ribs 24 and the dielectric glass layer 23. Phosphor inks each including a different one of the phosphor members for the different colors are applied to the grooves so that different grooves have different colors.

Each phosphor ink is prepared by putting one of the aforementioned phosphor members into a server so that it amounts to 50 mass % and adding ethyl cellulose by 0.1 mass % and a solvent (α-terpineol) by 49 mass %, and further stirring and mixing them together with a sand mill so that the viscosity is adjusted to $15\times10^{-3}$ Pa·s. The phosphor inks manufactured in this way are poured into containers, each for one of the colors, that are connected to pumps, and injected and applied, with the pump pressure, onto the walls of the grooves between the barrier ribs 24 from the nozzles having a diameter of 60 μm. The nozzles are moved along the lengthwise direction of the barrier ribs 24 so that the phosphor inks are applied in stripes.

After all the gaps between the barrier ribs 24 have a phosphor ink for one of the colors applied, the back glass substrate 21 is baked for about 10 minutes at a temperature of approximately 500 degrees centigrade so that the phosphor layers 25R, 25G, and 25B are formed.

Thus, the back panel 20 is completed. The following describes the manufacturing method of the green phosphor member which forms the characteristics of the present embodiment.

The Manufacturing Method of the Green Phoshor Member

Firstly, as the first stage of the manufacturing process of the green phosphor member, a predetermined amount of each of the ingredients ($BaCO_3$, $MnO_2$, $Al_2O_3$) used for manufacturing the normal green phosphor member whose composition is $BaAl_{12}O_{19}$:Mn is prepared. A predetermined amount of an oxide of silicon (e.g. $SiO_2$) is added to the ingredients, and the mixture as a whole is pulverized. Here, the amount of the silicon (Si) compound to be added is calculated in a backward manner so that when the green phosphor layer 25G is formed, the ratio of Si included in the layer is within the range between 100 mass ppm and 5,000 mass ppm inclusive.

In the second stage of the manufacturing process, after the mixed ingredients that have been pulverized are baked, they are pulverized again and sieved so that only the particles having diameters within a predetermined range are taken out. To summarize, at the stage of manufacturing the phosphor member, a silicon compound is added.

Thus, the green phosphor member is manufactured as a result of the manufacturing process described above.

Completion of the PDP 2

The prepared front panel 10 and back panel 20 are pasted and sealed together in the same manner as described in the first embodiment.

In addition, the hole that has been provided in order to put gas into and take gas out of the front panel 10 or the back panel 20 is sealed up so as to complete the PDP 2. It should be noted that it is desirable to set the amount of Xe included in the discharge gas as 5 volume % or more in order to improve the luminance.

The PDP 2 is for example applicable to a 40-inch class VGA and therefore the cell pitch is set to be 0.36 mm, and the distance between electrodes for the scan electrodes 12*a* and the sustain electrodes 12*b* is set to be 0.1 mm.

2-3. Driving of the PDP 2

In order to drive the PDP 2, the same driving method as used for driving the PDP 1 according to the first embodiment is applied; therefore, description is omitted.

2-4. Advantageous Features of the PDP 2

As described earlier, in the PDP 2, discharges are generated between the display electrodes 12 (the scan electrodes 12*a* and the sustain electrodes 12*b*) and the address electrodes 22 so that the phosphor members in the phosphor layers 25 are excited by ultraviolet rays generated from the discharge gas so as to result in fluorescent light emission.

As described earlier, the inventors of the present invention has confirmed that degradation of image quality due to occurrence of black noise experienced after the panel is driven for a long period of time is caused with a mechanism as described below: In a conventional PDP, the constituent elements (e.g. Si) in the phosphor layers are released into the discharge spaces and adhere to the surface of the dielectric protection layer on the front panel. Accordingly, the impedance of the dielectric protection layer changes. After the panel has been driven for a long period of time, the impedance of the dielectric protection layer falls outside the predetermined value range so as to result in occurrence of what is called black noise, which means that light does not turn on in a cell in which light should be turned on. Such occurrence of black noise lowers the image quality of PDPs to a great extent. Such changes in the impedance of the dielectric protection layer can be caused similarly in the case where a Group IV element besides Si, transition metal, alkali metal, or alkaline earth metal (except for Mg) adheres to the surface of the dielectric protection layer.

Further, even if a PDP has a Group IV element such as Si added to the dielectric protection layer during the manufacturing process, in order to adjust the impedance of the dielectric protection layer at a proper value at the initial stage of driving, the impedance of the dielectric protection layer deviates from the initial value as the driving period elapses and, at some point of time when a certain period has passed, the impedance deviates from the tolerance range.

In contrast, in the PDP of the present embodiment, Si is not included in the phosphor layers 25R and the phosphor layer 25B that are for red (R) and blue (B), whereas Si, which is a Group IV element, is included in the phosphor layer 25G that is for green (G) at the content ratio within the range between 100 mass pm and 5,000 mass ppm inclusive. Thus, the PDP 2 has an arrangement wherein no Si, which is a Group IV element, is included in any of the phosphor layers 25R, 25G, and 25B or wherein Si is included, if any, in a very small amount as defined with the value range above. With this arrangement, even after the panel has been driven for a long period of time, the amount of Si that may adhere to the surface of the dielectric protection layer 14 is limited. Consequently, with the limited amount of adhesion, the impedance of the dielectric protection layer 14 barely changes, and by setting the impedance of the dielectric protection layer so as to be within the appropriate range at the designing stage, occurrence of black noise never gets so prominent. The appropriate range of the values has been confirmed with the experiences to be described later.

It should be noted that in order to make the content ratio of Si in the green phosphor layer 25G "0" mass ppm, in other words, in order to arrange it so that no Si is included at all, a green phosphor member that does not contain Si in its composition should be selected, and the layer should be formed of materials that do not contain Si; however, a green phosphor layer that contain no Si in its composition has a lower luminance than a phosphor layer 25G that includes Si even in a small amount. Accordingly, in the present embodiment, a phosphor member that does not contain Si in its composition is used as the base material so as to prepare a phosphor member to which a very small amount of Si is added at the ratio within the range between 100 mass ppm and 5,000 mass ppm inclusive.

It is acceptable to define the content ratio of Si so as to be within the range between 100 mass ppm and 5,000 mass ppm inclusive, not only for the green phosphor layer 25G but also for the red and blue phosphor layers 25R and 25B.

In addition to the advantageous feature by which the impedance of the dielectric protection layer barely changes even after the panel has been driven for a long period of time, the PDP 2 also has a feature by which the impedance of the dielectric protection layer 14 at the initial stage of driving is at an appropriate level with an arrangement wherein Si is added to the dielectric protection layer 14 at the ratio of 1,500 mass ppm at the manufacturing stage.

Accordingly, in the PDP 2, the panel luminance is high, and also the impedance of the dielectric protection layer is maintained within an appropriate range, regardless of the length of the driving period; therefore, occurrence of black noise does not increase and image quality is maintained high.

2-5. Confirmation Experiments

Experiments were conducted in order to back up the advantageous features of the PDP 2 described above and in order to specify the optimal content ratio of the elements to be included in the phosphor layers.

Impedance Measuring Apparatus and Accelerated Degradation Testing Apparatus

The impedance measuring apparatus and the accelerated degradation testing apparatus are configured to be the same as the ones used in the confirmation experiments for the first embodiment.

The Experiment 1

Firstly, as the experiment 1, experiments were conducted in order to find out relationship among the ratio of Si included in the phosphor layer, the impedance of the dielectric protection layer, and the luminance of the phosphor layers. The samples used in the tests are shown in the Table 4.

TABLE 4

| | Green Phosphor Layer | | Dielectric Protection |
|---|---|---|---|
| Sample Number | Phosphor member composition | Si Ratio (ppm) | Layer Si Ratio (ppm) |
| 1 | $BaAl_{12}O_{19}$:Mn | 0 | 0 |
| 2 | $BaAl_{12}O_{19}$:Mn | 200 | 0 |
| 3 | $BaAl_{12}O_{19}$:Mn | 7,000 | 0 |

Among the three kinds of samples shown in the Table 4, the phosphor layer labeled as Sample No. 2 is manufactured with the same method used to manufacture the green phosphor layer in the PDP 2 according to the second embodiment described above. In the phosphor layer labeled as Sample No. 3, the content ratio of Si is 7,000 mass ppm. As for the dielectric protection layers in the samples, they were manufactured with the same method used to manufacture the dielectric protection layer 14 in the PDP 2. It should be noted, however, that no Si is included in the dielectric protection layer.

Five pieces were manufactured for each type of the Samples No. 1 through No. 3. For each sample, the impedance of the dielectric protection layer was measured before an accelerated degradation test was conducted. At predetermined time intervals such as 100 hours and 200 hours, the dielectric layers were taken out so as to measure their impedances.

The luminance was also measured at different stages of elapsed time during the accelerated degradation test. The average of the five pieces for each type of the Samples No. 1 through No. 3 is shown in FIG. 4 as the measurement results.

Figure 4:
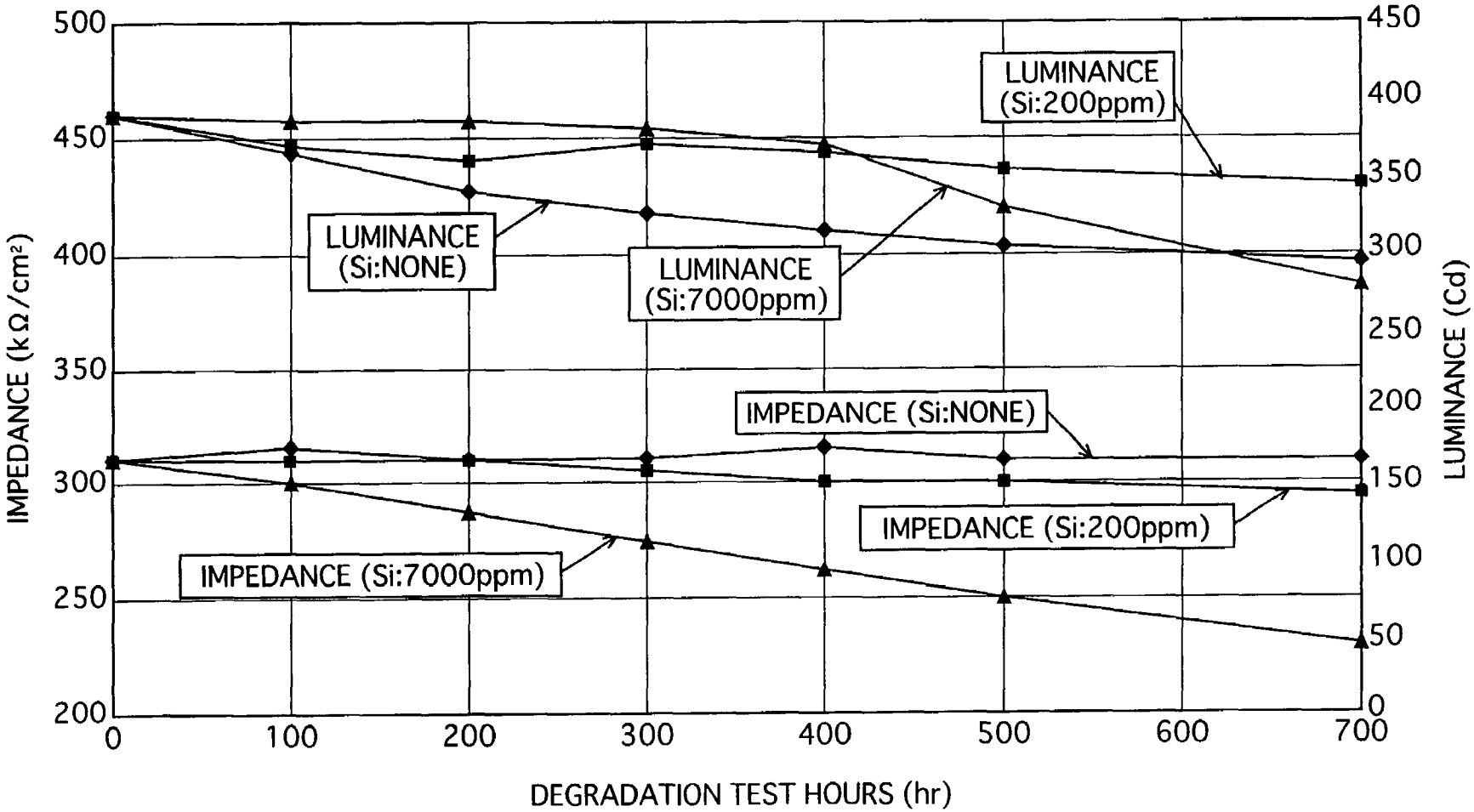
FIG. 4 is a characteristic graph that shows the relationship among degradation testing hours, the impedance of the dielectric protection layer, and the luminance.

As shown in FIG. 4, the impedances of the dielectric protection layers are, for all of NO. 1 through No. 3, 310 kΩ/cm$^2$ before the accelerated degradation test is started. Here, it should be noted that Si is not added to the dielectric protection layer at the manufacturing stage.

For the Sample No. 1 in which no Si was included in the phosphor layer at all, the impedance of the dielectric protection layer was fixed (around 310 kΩ/cm$^2$ to 320 kΩ/cm$^2$) regardless of the testing period of the accelerated degradation test.

In contrast, with the sample in which Si was included in the phosphor layer at the ratio of 200 mass ppm, the impedance of the dielectric protection layer gradually lowered as the testing time elapsed.

With the Sample No. 3 in which the content ratio of Si in the phosphor layer was 7,000 mass ppm, the impedance of the dielectric protection layer started to lower greatly, immediately after the start of the accelerated degradation test, and when 700 hours had passed, the impedance was as low as 230 kΩ/cm$^2$.

Next, as shown in FIG. 4, as for the luminance, up to the point where 400 hours had elapsed, the sample No. 3, which has the highest content ratio (7,000 mass ppm) of Si in the phosphor layer, had the highest luminance, and the sample No. 2 had the second highest luminance and the sample No. 1 had the lowest luminance.

When the testing period had exceeded 400 hours, however, the luminance of the No. 3 sample abruptly lowered, and the Sample No. 2 in which the content ratio of Si was 200 mass ppm got to have the highest luminance.

When we consider overall the two main factors such as stability of the impedance of the dielectric protection layer and the luminance, it is understood that the Sample No. 2 in which Si is included in the phosphor layer at the ratio of 200 mass ppm is the most advantageous. To be more specific, it is preferable to add Si, even in a very small amount, to the phosphor layer in view of the level of luminance, and also it is necessary to limit the content ratio to be low in view of stability of the impedance of the dielectric protection layer.

It should be noted that although the data is not provided, even in a case where the content ratio of Si in the phosphor layer is 100 mass ppm, it has been confirmed that the luminance is hardly different from the No. 2 sample shown above.

The Experiment 2

For the Experiment. 2, samples No. 11 thorough No. 14 were manufactured which have mutually different arrangements with respect to the phosphor member composition, the content ratio of Si in the layer, and the content ratio of Si in the dielectric protection layer. Accelerated degradation tests were conducted for 500 hours and the impedances of the dielectric protection layers were measured before and after the tests. The characteristics of the samples and the impedance measurement results are shown in the Table 5.

TABLE 5

| | Green Phosphor Layer | | Dielectric Protection | Impedance (kΩ/cm$^2$) | |
|---|---|---|---|---|---|
| Sample Number | Phosphor member composition | Si Ratio (ppm) | Layer Si Ratio (ppm) | Initial Stage of Driving | After Degradation Test |
| 11 | $Zn_2SiO_4$:Mn | — | 1,500 | 265 | 190 |
| 12 | $Zn_2SiO_4$:Mn | — | 0 | 310 | 230 |
| 13 | $BaAl_{12}O_{19}$:Mn | 200 | 1,500 | 265 | 260 |
| 14 | $BaAl_{12}O_{19}$:Mn | 200 | 0 | 310 | 305 |

PDPs were manufactured which comprise green phosphor layers and dielectric protection layers that are the same as in the Samples No. 11 through 14. Tests were conducted under the same condition as the accelerated degradation tests described above, and the image quality before and after the tests were visually evaluated. The characteristics of the PDPs (the green phosphor layers and the dielectric protection layers) and the evaluation results of image quality are shown in the Table 6.

TABLE 6

| | Green Phosphor Layer | | Dielectric Protection | Image Quality Evaluation | |
|---|---|---|---|---|---|
| Sample Number | Phosphor member composition | Si Ratio (ppm) | Layer Si Ratio (ppm) | Initial Stage of Driving | After Degradation Test |
| P11 | $Zn_2SiO_4$:Mn | — | 1,500 | 5 | 2 |
| P12 | $Zn_2SiO_4$:Mn | — | 0 | 4 | 4 |
| P13 | $BaAl_{12}O_{19}$:Mn | 200 | 1,500 | 5 | 5 |
| P14 | $BaAl_{12}O_{19}$:Mn | 200 | 0 | 4 | 4 |

It should be noted that in the PDPs of the Samples No. P11 through No. P14 shown in the Table 6, the constituent parts other than the ones shown in the table are the same as those in the PDP 2 according to the second embodiment.

Further, the standard used to evaluate the image quality of each panel for the tests is the same as the one that is shown in the Table 1 and were used in the confirmation experiments in the first embodiment.

As shown in the Table 5, in the Samples No. 11 and No. 12 both in which the phosphor member composition is $Zn_2SiO_4$:Mn, the impedance of the dielectric protection layer lowered largely with the degradation tests. In the Sample No. 11 in which Si is included in the dielectric protection layer at the ratio of 1,500 mass ppm in order to make the impedance of the dielectric protection layer at the initial stage of driving 265 kΩ/cm$^2$, the impedance after the accelerated degradation test dropped to 190 kΩ/cm$^2$, which was below the lower limit of the tolerance range being 220 kΩ/cm$^2$.

In contrast, in the Samples No. 13 and No. 14 in which the content ratio of Si in the phosphor layer was 200 mass ppm, the impedance hardly changed between before and after the accelerated degradation tests. In particular, with the Sample No. 13, the impedance was maintained before and after the accelerated degradation test at 260 kΩ/cm$^2$ to 265 kΩ/cm$^2$ which is a superior level.

As shown in the Table 6, the image quality evaluation of the PDP Sample No. P11 was at level 5 at the initial stage of driving (before the accelerated degradation test) and was down to level 2, which is a non-passing level, after the accelerated degradation test.

The image quality evaluation of the PDP Sample No. P12 was at level 4 for both before and after the accelerated degradation test; however, as shown in the Table 2, level 4 at the initial stage of driving is accompanied with the impedance being the upper limit value of the tolerance range, whereas level 4 after the accelerated degradation is accompanied with the impedance being the lower limit value of the tolerance range. Consequently, if the accelerated degradation test had been continued a little longer (for example, 100 hours) with this sample, it is easily conjectured that the impedance of the dielectric protection layer would have dropped below the lower limit value of the tolerance range.

In contrast, with the PDP Samples of No. P13 and No. P14, there was no change between the image quality level at the initial stage of driving and the image quality level after the accelerated degradation test, and also the impedances barely differ from the ones shown in the Table 2; therefore, it is considered that even if the accelerated degradation test had been continued longer, the image quality would not have been degraded easily.

As results of the above, it is understood that in a PDP that has a high content ratio of Si in the phosphor layer, degradation of the image quality is large in the case where the driving of the panel lasts for a long period of time, whereas in a PDP that has a low content ratio of Si in the phosphor layer such as 200 mass ppm, degradation of image quality due to black noise occurrence is small even if the driving of the panel lasts for a long period of time.

It should be noted that the same experiment results are obtained in a case where any of the Group IV elements such as Ti, Zr, Hf, C, Ge, Sn, Pb, or the like (any of Group IV elements), is included in the phosphor layer, instead of Si.

The Experiment 3

Next, an experiment was conducted to find out the optimal range of the content ratio of Si in the phosphor layer.

The samples used in the experiments were five types being No. 21 through No. 25 shown in the Table 7. Five pieces were made for each type of sample and, like in the Experiment 2, the impedances of the dielectric protection layers were measured after accelerated degradation tests of 500 hours.

TABLE 7

| | Green Phosphor Layer | | Dielectric Protection |
|---|---|---|---|
| Sample Number | Phosphor member composition | Si Ratio (ppm) | Layer Si Ratio (ppm) |
| 21 | $BaAl_{12}O_{19}$:Mn | 0 | 1,500 |
| 22 | $BaAl_{12}O_{19}$:Mn | 1,000 | 1,500 |
| 23 | $BaAl_{12}O_{19}$:Mn | 3,000 | 1,500 |
| 24 | $BaAl_{12}O_{19}$:Mn | 5,000 | 1,500 |
| 25 | $BaAl_{12}O_{19}$:Mn | 7,000 | 1,500 |

Figure 7:
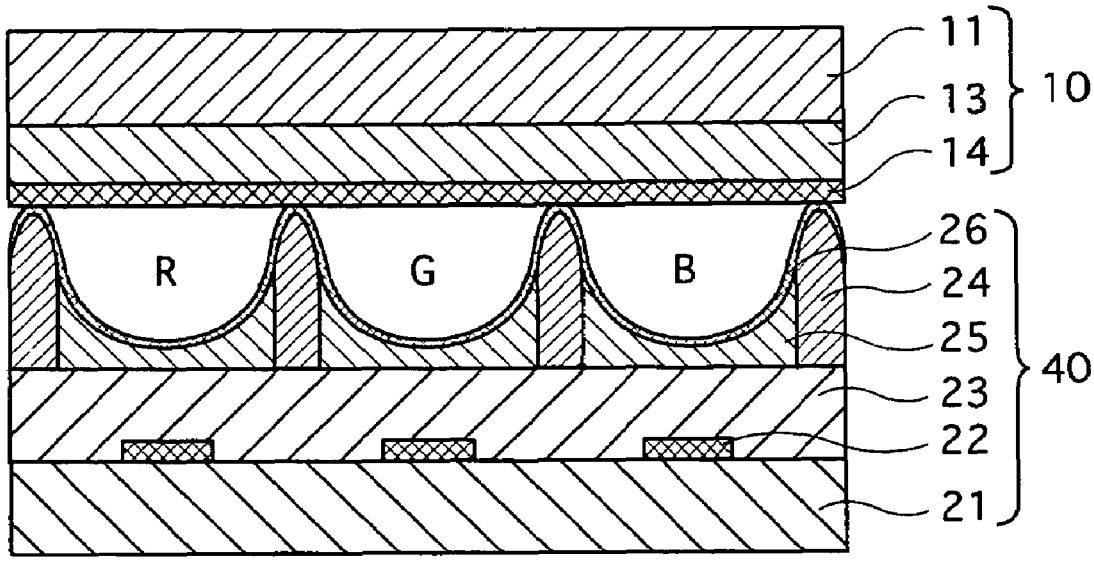
FIG. 7 is a perspective view (partially, cross sectional view) of the principal part of the PDP 3 according to the third embodiment.

As shown in FIG. 7, Si was included in the dielectric protection layer at the ratio of 1,500 mass ppm in each of all the samples used in this experiment, while the content ratios of Si in the green phosphor layers to be used in the accelerated degradation tests were varied to be at five different levels. The phosphor member used as the base material was $BaAl_{12}O_{19}$:Mn, like in the Experiment 1 above.

Figure 5:
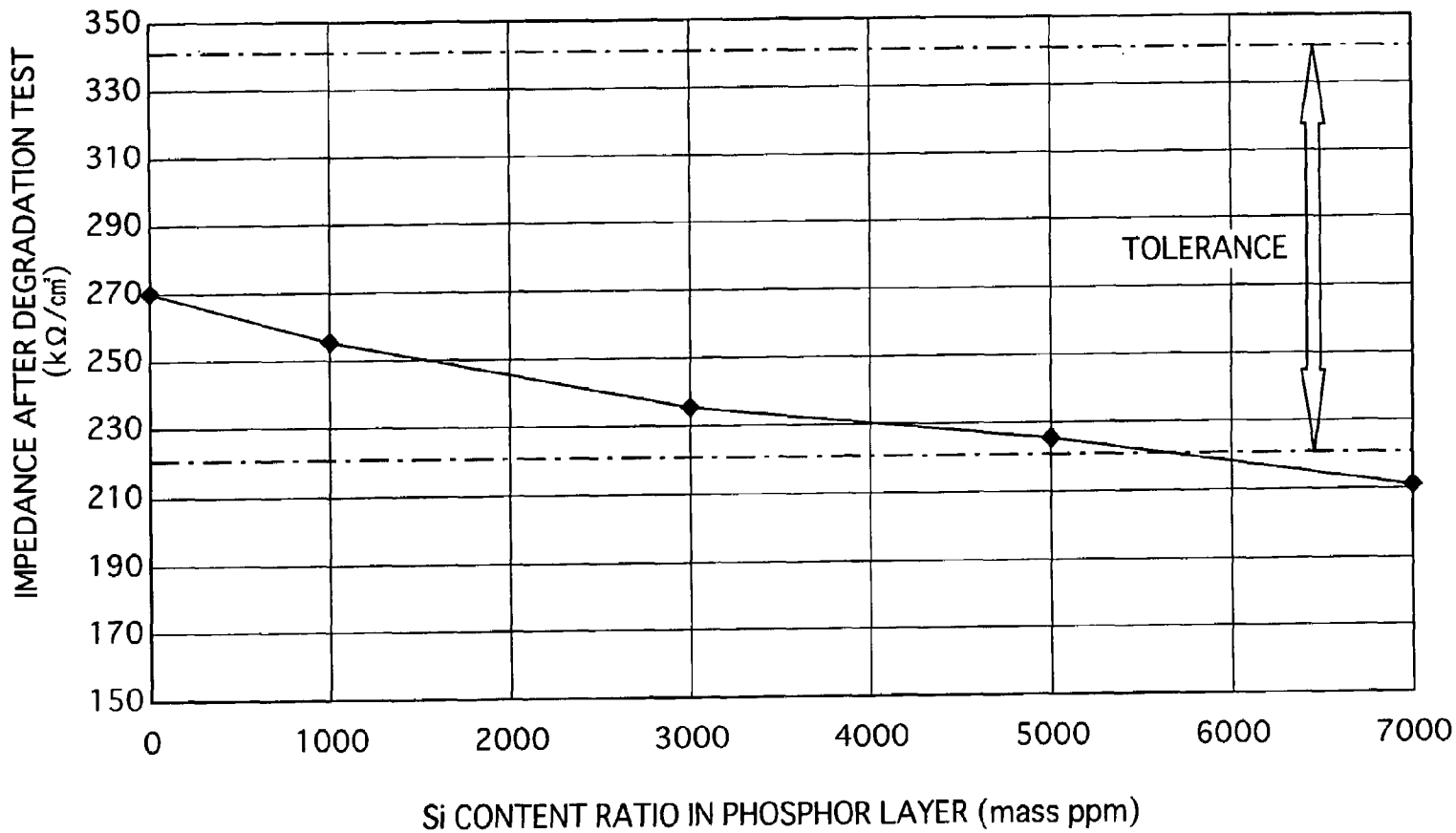
FIG. 5 is a characteristic graph that shows the relationship between the content ratio of Si in the phosphor layer and the impedance of the dielectric protection layer after accelerated degradation tests.

The measurement results of the impedances of the dielectric protection layers after the accelerated degradation tests are shown in FIG. 5. In FIG. 5, the average of the five pieces for each type of the samples No. 21 through No. 25 is shown as a measurement result.

As shown in FIG. 5, the higher the content ratio of Si in the phosphor layer was, the lower the impedance of the dielectric protection layer after the accelerated degradation tests was. With the sample No. 25 in which the content ratio of Si exceeds 5,000 mass ppm, the impedance was below the lower limit of the tolerance range, which is 220 kΩ/cm$^2$.

From the data in FIG. 5, it is understood that in order to keep the impedance of the dielectric protection layer over the lower limit of the tolerance range, the content ratio of Si in the phosphor layer should be 5,000 mass ppm or lower. The reason was that, in the Sample No. 25 in which the content ratio of Si in the phosphor layer exceeds 5,000 mass ppm, an amount of Si that is large enough to lower the impedance below the lower limit of the tolerance range adhered to the surface of the dielectric protection layer through the accelerated degradation test of 500 hours.

As observed from the Experiments 1 through 3, an appropriate range for the content ratio of at least one Group IV element to be included in the phosphor layer is between 200 mass ppm and 5,000 mass ppm inclusive, in view of luminance and stability of the impedance of the dielectric protection layer.

The Experiment 4

In the Experiments 1 through 3, Group IV elements to be included in the phosphor layers were studied. The present experiment focused on the relationship between the content ratio of tungsten (W), which is a transition metal, to be included in the phosphor layer and the impedance of the dielectric protection layer. A result of the studies conducted by the inventors of the present invention shows that it is desirable to make the content ratio of a transition metal in the phosphor layer 500 mass ppm or higher. The reason is the same as the one for the Group IV elements such as Si, explained above. To be more specific, when no transition metal is adhered to the surface of the dielectric protection layer, even if a pulse is applied, the discharge (light emission) finishes in a relatively short period of time; however, when some transition metal is adhered, the discharge (light emission) lasts for a relatively long period of time.

With the present experiment, the Samples No. 31 through No. 34 were manufactured which have mutually different arrangements with respect to the phosphor member composition, the content ratio of W in the layer, and the content ratios of Si and W in the dielectric protection layer. Accelerated degradation tests were conducted for 500 hours, and the impedances of the dielectric protection layers were measured before and after the tests, like in the Experiment 2. The characteristics of the samples and the impedance measurement results are shown in the Table 8.

TABLE 8

| | | | Dielectric Protection Layer | | Impedance (kΩ/cm$^2$) | |
|---|---|---|---|---|---|---|
| Sample Number | Blue Phosphor Layer: Phosphor member composition | Blue Phosphor Layer: W Ratio (ppm) | Si Ratio (ppm) | W Ratio (ppm) | Initial Stage of Driving | After Degradation Test |
| 31 | $CaWO_4$:Pb | — | 2,000 | 1,000 | 295 | 360 |
| 32 | $CaWO_4$:Pb | — | 0 | 0 | 310 | 370 |
| 33 | $BaAl_{10}O_{17}$:$Eu^{2+}$ | 1,000 | 2,000 | 1,000 | 295 | 300 |
| 34 | $BaAl_{10}O_{17}$:$Eu^{2+}$ | 1,000 | 0 | 0 | 305 | 310 |

It should be noted that as shown in the Table 8, in the Samples No. 31 and No. 33 W (1,000 mass ppm) and Si (2,000 mass ppm) both are included in the dielectric protection layer. The reason is if only W was included in the dielectric protection layer, its impedance would become too high.

It should be also noted that it is not necessary for the dielectric protection layer to contain Si. Si is included merely for making the impedance of the dielectric protection layer closer to the central value in the appropriate range.

Figure 8:
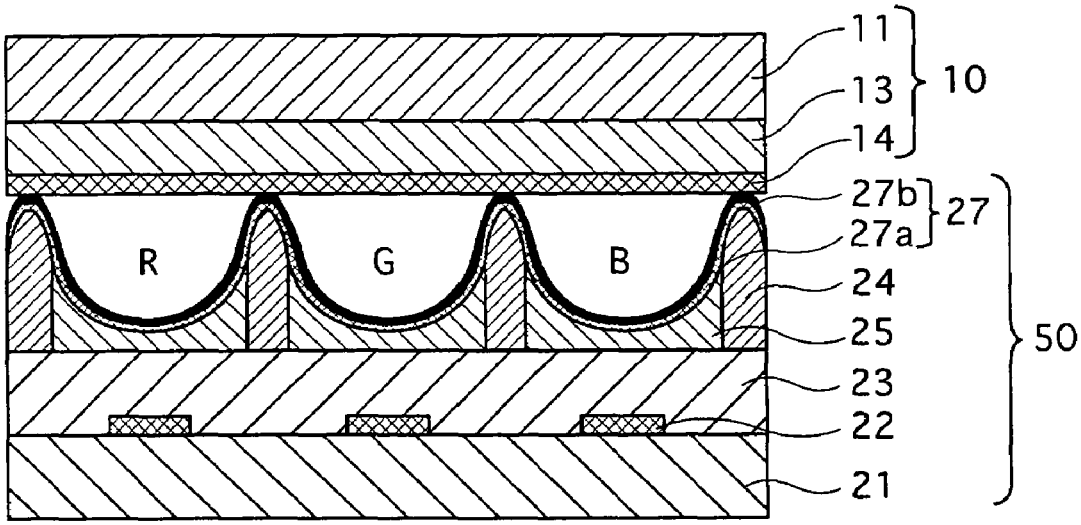
FIG. 8 is a perspective view (partially, cross sectional view) of the principal part of the PDP 4 according to the fourth embodiment.

As shown in FIG. 8, in the Samples No. 31 and No. 32 in which $CaWO_4$:Pb is included as the phosphor member, the changes in the impedances of the dielectric protection layer between the initial stage of driving and after the accelerated degradation tests were large. The impedances after the accelerated degradation tests exceeded the upper limit of the tolerance range of impedance, regardless of whether Si and W were included in the dielectric protection layers.

In contrast, in the Samples No. 33 and No. 34 in which W was included in the phosphor layer at the ratio of 1,000 mass ppm, the impedance value increased only by five points between the initial stage of driving and after the accelerated degradation test, which means the impedance was stable.

Further, in the Sample No. 33 in which Si at the ratio of 2,000 mass ppm and W at the ratio of 1,000 mass ppm were included in the dielectric protection layer in advance, it was possible to make the impedance of the dielectric protection layer at the initial stage of driving a more appropriate value. This tendency did not change even after the accelerated degradation test.

Next, PDPs were manufactured each of which comprised a blue phosphor layer and a dielectric protection layer that are the same as those in each of the Samples No. 31 through No. 34. Image quality was evaluated before and after accelerated degradation tests that were conducted under the same conditions as the tests described above. The characteristics of the PDPs and the image quality evaluation results are shown in the Table 9.

TABLE 9

| Sample Number | Blue Phosphor Layer: Phosphor member composition | Blue Phosphor Layer: W Ratio (ppm) | Dielectric Protection Layer: Si Ratio (ppm) | Dielectric Protection Layer: W Ratio (ppm) | Image Quality Evaluation: Initial Stage of Driving | Image Quality Evaluation: After Degradation Test |
|---|---|---|---|---|---|---|
| P31 | $CaWO_4$:Pb | — | 2,000 | 1,000 | 5 | 3 |
| P32 | $CaWO_4$:Pb | — | 0 | 0 | 4 | 3 |
| P33 | $BaAl_{10}O_{17}:Eu^{2+}$ | 1,000 | 2,000 | 1,000 | 5 | 5 |
| P34 | $BaAl_{10}O_{17}:Eu^{2+}$ | 1,000 | 0 | 0 | 4 | 4 |

It should be noted that in the PDPs of the Samples No. P31 through No. P34 shown in the Table 9, the constituent parts other than the ones shown in the table are the same as those in the PDP 2 according to the second embodiment.

Further, the standard used to evaluate the image quality of each panel during the tests is the same as the one shown in the Table 1, like the Experiment 2.

As shown in the Table 9, the Samples No. 31 and No. 32 in which $CaWO_4$:Pb is used as the phosphor member in the blue phosphor layer, image quality after the accelerated degradation test was evaluated as Level 3, which is a non-passing level. These results are in compliance with the impedances of the dielectric protection layers shown in the Table 8.

In contrast, with the Samples No. P33 and No. P34, no degradation of image quality was observed even after the accelerated degradation test, and the image quality was maintained at a good level. In particular, with the Sample No. P33 in which Si and W were included in the dielectric protection layer, since the impedance of the dielectric protection layer was adjusted to be an optimal value during the manufacturing process, the evaluation result even after the accelerated degradation test was Level 5, which is the highest level.

From the results of the experiment, it is understood that in the case where the content ratio of W in the phosphor layer is too high, the impedance of the dielectric protection layer increases largely, and occurrence of black noise becomes prominent, after the PDP has been driven for a long period of time. Also, in the case where the content ratio of W in the phosphor layer is arranged to be 1,000 mass ppm, the impedance of the dielectric protection layer is stable even after an accelerated degradation test, and the PDPs comprising such layers have little image quality degradation.

It should be noted that, in order to put W into a blue phosphor layer at the ratio of 1,000 mass ppm, $BaMgAl_{10}O_{17}:Eu^{2+}$ is used as the base material like in the second embodiment, and after a tungsten compound (for example, tungsten oxide) is added to the base material, the mixture goes through the steps of mixing, baking, and pulverizing.

The Experiment 5

Next, like in the Experiment 3, another experiment was conducted to find out the optimal range of the content ratio of W in the phosphor layer.

Figure 6:
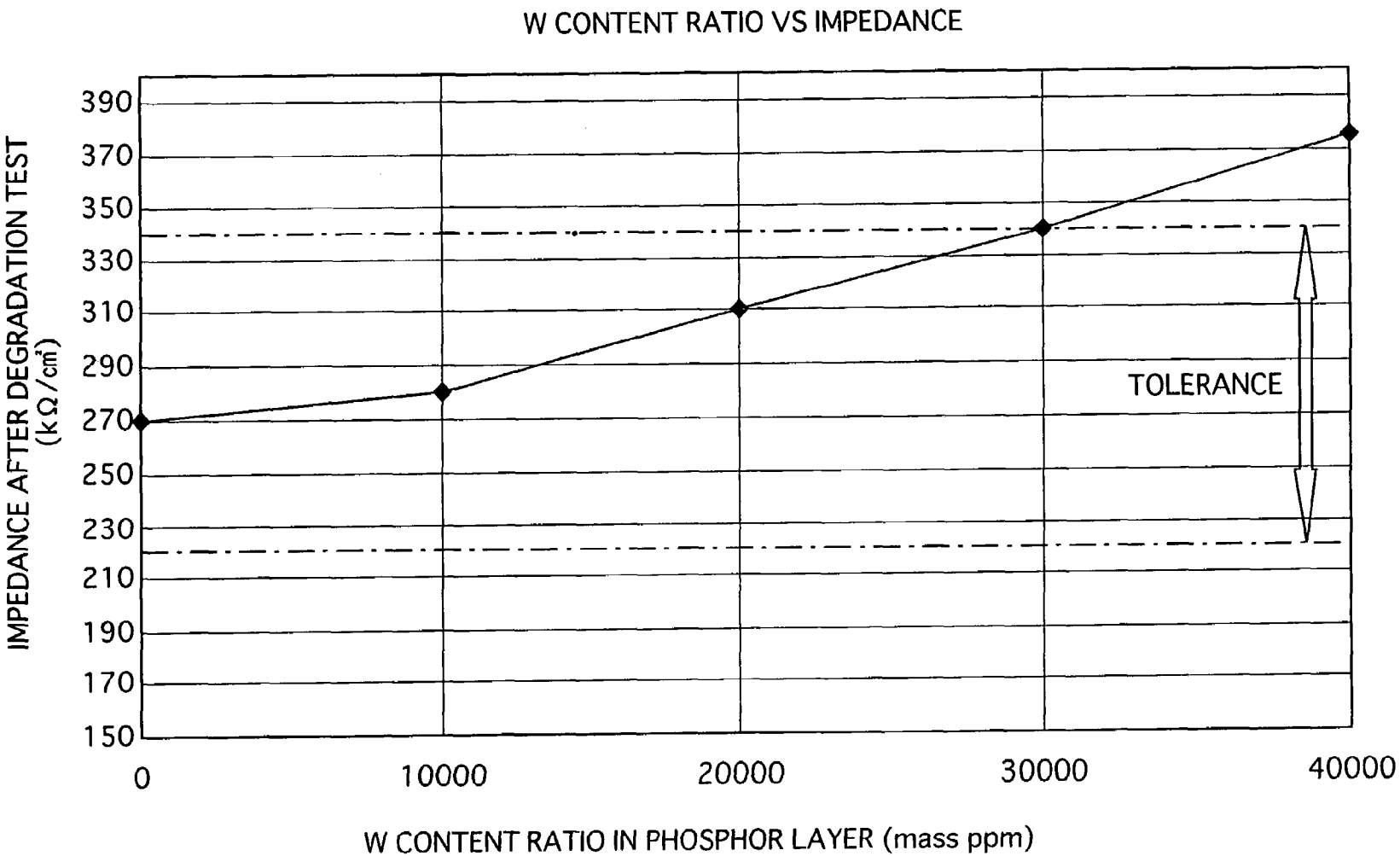
FIG. 6 is a characteristic graph that shows the relationship between the content ratio of W in the phosphor layer and the impedance of the dielectric protection layer after accelerated degradation tests.

The samples used in the experiments were of five types being No. 41 through No. 45 that had mutually different arrangements with respect to only the content ratio of W in the phosphor layer. Five pieces were manufactured for each type of sample and, like in the Experiment 3, the impedances of the dielectric protection layers were measured after accelerated degradation tests of 500 hours. The characteristics of the samples are shown in the Table 10, and the impedance measurement results are shown in FIG. 6.

TABLE 10

| Sample Number | Blue Phosphor Layer: Phosphor member composition | Blue Phosphor Layer: Si Ratio (ppm) | Dielectric Protection Layer Si Ratio (ppm) |
|---|---|---|---|
| 41 | $BaMgAl_{10}O_{17}:Eu^{2+}$ | 0 | 1,500 |
| 42 | $BaMgAl_{10}O_{17}:Eu^{2+}$ | 10,000 | 1,500 |
| 43 | $BaMgAl_{10}O_{17}:Eu^{2+}$ | 20,000 | 1,500 |
| 44 | $BaMgAl_{10}O_{17}:Eu^{2+}$ | 30,000 | 1,500 |
| 45 | $BaMgAl_{10}O_{17}:Eu^{2+}$ | 40,000 | 1,500 |

As shown in the Table 10, the content ratios of W in the phosphor layers in the Sample No. 41 through No. 45 were 0 mass ppm, 10,000 mass ppm, 20,000 mass ppm, 30,000 mass ppm, and 40,000 mass ppm, respectively.

It should be noted that the dielectric protection layer of each of all these samples was arranged so that the impedance at the initial stage of driving be 270 kΩ/cm$^2$, with an arrangement wherein the dielectric protection layer did not contain W, but contained Si at the ratio of 1,500 mass ppm.

As shown in FIG. 6, there is correlation between the content ratio of W in the phosphor layer and the impedance of dielectric protection layer after an accelerated degradation test. The higher the content ratio is, the higher the impedance after an accelerated degradation test is. Moreover, with the Sample No. 45 in which the content ratio of W in the phosphor layer was 40,000 mass ppm, the impedance of the dielectric protection layer after the accelerated degradation test exceeded the upper limit of the tolerance range, which is 340 kΩ/cm$^2$. In other words, it is conjectured that a PDP comprising the phosphor layer of No. 45 will have, after a long period of driving, prominent black noise occurrence, and experience degradation of image quality down to a non-passing level.

From the results of the experiment, it is understood that the optimal range of the content ratio of W in the phosphor layer is between 500 mass ppm and 30,000 mass ppm inclusive.

It should be noted that although W is contained in the phosphor layer in this experiment, it is possible to have another arrangement wherein an element such as Mn, Fe, Co, or Ni contained in the phosphor layer. In such a case, the optimal range of the content ratio of such an element and the effects achieved by having such an element contained are the same as the case where W is contained.

Further, it should be noted that although the experiment data is not provided, even with an arrangement wherein one or both of alkali metal and alkaline earth metal (except for Mg) are included in the phosphor layer at the ratio between 1,000 mass ppm and 60,000 mass ppm inclusive, it is possible to obtain a PDP that has little occurrence of black noise and little image quality degradation even after a long time period of driving.

2-6. Other Information Related to the Second Embodiment

In the second embodiment, explanation is provided taking an example of PDP in which Si is included in each of the phosphor layers 25R, 25G, and 25B at the ratio between 100 mass ppm and 5,000 mass ppm inclusive; however, as indicated with the confirmation experiments, it is possible to achieve the same effects with an arrangement wherein another Group IV element instead of Si is included at the same ratio.

Also, it is possible to achieve the same effect with an arrangement wherein, instead of a Group IV element, transition metal such as W is included at the ratio between 500 mass ppm and 30,000 mass ppm inclusive or an arrangement wherein one or both of alkali metal and alkaline earth metal (except for Mg) are included at the ratio between 1,000 mass ppm and 60,000 mass ppm inclusive.

Further, it is acceptable to have a combination of any of the aforementioned elements included in the phosphor layer.

The method to be used to have a phosphor layer contain one or more elements such as a Group IV element is not limited to the one described above as long as the elements are included in the phosphor layer when PDPs are completed. For example, it is acceptable to add such elements during the manufacturing process of a phosphor ink where the phosphor member is mixed with ethyl cellulose and α-terpineol. It should be noted, however, in such a case, such elements exist as adhering to both sides of the phosphor particles; therefore, this modification is rather less advantageous than the first embodiment in terms of uniformity of the contained elements.

The phosphor material to be used as the base material is not limited to the ones described in the embodiments above. For example, in a case where Si is included in an extremely small amount (around 100 mass ppm), it is acceptable to use a phosphor member that does not contain Si in its composition. Even in the case where a predetermined amount of another kind of element is included, it is similarly acceptable to use, as the base material, a phosphor member that does not contain the intended element in its composition.

Furthermore, in the second embodiment, the content ratio of the Group IV element to be included in the phosphor layer 25G is controlled; however, it is also effective to control the content ratio of one or more elements (Group IV element, transition metal, alkali metal, alkaline earth metal) to be included in some other portions that face the discharge spaces 30R, 30G, or 30B, for example, in some parts of the barrier ribs 24 that are not covered by the phosphor layer 25. Especially, controlling the content ratio of the one or more elements to be included at the tops of the barrier ribs 24 or in auxiliary barrier ribs is even more effective in suppressing the changes in the impedances of the dielectric protection layer.

Moreover, as observed from the experiment results, it is possible to achieve the object of suppressing black noise occurrence to be experienced after a long time period of driving, even with an arrangement wherein none of the phosphor layers for R, G, and B include any of Group IV elements, transition metals (W, Mn, Fe, Co, Ni), alkali metals, and alkaline earth metals (except for Mg). To be more specific, the content ratio defined in the second embodiment regarding the elements to be included such as a Group IV element is within a range that has substantially no influence on the impedance of the dielectric protection layer even if such elements (e.g. a Group IV element) included in the phosphor layer disperse into the discharge space while the panel is driven. In view of this, it is possible to achieve the same effect with an arrangement wherein none of the phosphor layers contain any of such elements as a Group IV element. However, as mentioned in the observations of the experiments above, it is preferable to have a very small amount of such an element or such elements included in the phosphor layer, because it makes it possible to improve the luminance of the panel.

Furthermore, it is possible to achieve substantially the same effect as above with an arrangement wherein all of the phosphor layers are formed using, as their constituent element, a phosphor member that does not contain any of Group IV elements, transition metals (W, Mn, Fe, Co, Ni), alkali metals, and alkaline earthmetals (except for Mg) in its composition. More specifically, it is possible to substantially suppress the changes in discharge characteristics of the dielectric protection layer during driving of a panel with an arrangement wherein the phosphor member included in a phosphor layer as a constituent element accounts for a large part of the phosphor layer, but the phosphor member accounting for the large part does not contain any of the aforementioned elements in its composition.

The Third Embodiment 3-1. Configuration and Advantageous Features of the PDP 3

The following describes the PDP 3 according to the third embodiment with reference to FIG. 7, mainly focusing on the differences from the second embodiment.

As shown in FIG. 7, the differences between the PDP 3 according to the present embodiment and the PDP 2 according to the second embodiment lie in the configuration of the back panel 40.

In the back panel 40, the configurations of the back glass substrate 21, the address electrode 22, the dielectric glass layer 23, and the barrier ribs 24 are the same as in the PDP 2 described above; however, the PDP 3 is different from the PDP 2 described above in the composition of the green phosphor member within the phosphor layers 25 and in that a phosphor protection layer 26 is formed on parts of the barrier ribs 24 that are not covered with the phosphor layers 25.

Firstly, among the phosphor members included in the phosphor layers 25, a phosphor member whose composition is $Zn_2SiO_4$:Mn is used for the green phosphor member, like the one generally used in the PDP 1 according to the first embodiment. The phosphor layer including this phosphor member contains a large amount of Si in its composition; therefore, the substantial amount of visible light emission per pulse is large, and the luminance is high.

The phosphor protection layer 26 is a thin layer being made of magnesium fluoride ($MgF_2$) and having a thickness of approximately 1.0 μm. The ultraviolet ray transmittance rate for the wavelength 147 nm of the phosphor protection layer 26 is 85%. Here, if the ultraviolet ray transmittance rate of the phosphor protection layer 26 is equal to or higher than 80%, there is no problem in practical use of PDPs.

On the back glass substrate 21 that has been through the manufacturing process according to the second embodiment up to where the phosphor layers 25 have been formed, the phosphor protection layer 26 is formed by generating, with an EB evaporation method, a layer of $MgF_2$ having a thickness of 1.0 μm on a surface of the back glass substrate 21 that has the phosphor layers 25 formed thereon.

It should be noted that in the PDP 3 according to the present embodiment, in order to make the distance between the front panel 10 and the back panel 40 the same as that in the PDP 2 described above, it is desirable to make the height of each of the barrier ribs 24 lower by the thickness of the phosphor protection layer 26 (1.0 μm).

In the PDP 3 having the arrangement as described above, the element (e.g. Group IV element, transition metal, alkali metal, alkaline earth metal, or the like) included in the phosphor layers does not disperse into the discharge spaces even if discharges are generated during the driving of the panel accompanying light emission. In particular, as described above, since a phosphor member that contains Si in its composition is used as a constituent element of the green phosphor layer 25G, a large amount of Si is included in the layer; however, because of the phosphor protection layer 26 that covers over the layer, dispersion of Si into the discharge spaces 30 is inhibited. To be more specific, even if different kinds of elements in the phosphor layers try to disperse into the discharge spaces when discharges are generated during the driving of the panel accompanying light emission, the phosphor protection layer 26 covering the surfaces of the phosphor layers 25 inhibits such dispersion.

Further, in the case where the barrier ribs 24 are exposed in the discharge spaces, the constituent elements (e.g. Si) of the barrier ribs 24 may disperse in an extremely small amount, if any. In the PDP 3 of the present embodiment, since the barrier ribs 24 are shielded and separated from the discharge spaces 30R, 30G, and 30B by the phosphor protection layer 26, dispersion of such elements from the barrier ribs 24 into the discharge spaces 30 is also inhibited.

Accordingly, in the PDP 3, the impedance of the dielectric protection layer 14 hardly changes through driving of the panel, and the luminance for the whole panel is also high.

It should be noted that although in the description above the phosphor protection layer 26 is formed with a thickness of 1.0 μm, the present invention is not necessarily limited to this thickness.

3-2. Confirmation Experiments

Experiments as below were conducted in order to confirm the advantageous features of the PDP 3 according to the third embodiment.

Firstly, the difference was checked in terms of the changes in the impedances of the dielectric protection layers between before and after accelerated degradation tests, depending on whether or not the phosphor protection layer 26 was provided. The characteristics of the samples used in the tests and the impedance measurement results are shown in the Table 11.

TABLE 11

| Sample Number | Phosphor Protection Layer | Dielectric Protection Layer Si Ratio (ppm) | Impedance (kΩ/cm$^2$) Initial Stage of Driving | Impedance (kΩ/cm$^2$) After Degradation Test |
|---|---|---|---|---|
| 51 | Yes | 1,500 | 270 | 275 |
| 52 | Yes | 0 | 310 | 305 |
| 53 | No | 1,500 | 270 | 220 |
| 54 | No | 0 | 315 | 270 |

As shown in the Table 11, in the Samples No. 51 and No. 52 a phosphor protection layer was formed in the same manner as in the second embodiment described above, whereas in the Samples No. 53 and No. 54 no phosphor protection layer was formed over the phosphor layers.

Further, in the Samples No. 51 and No. 53, Si was included in the dielectric protection layer at the ratio of 1,500 mass ppm, whereas in the Samples No. 52 and 54, no Si was included.

It should be noted that a phosphor layer being formed of a green phosphor member whose composition was $Zn_2SiO_4$:Mn was used as the phosphor layer.

As shown in the Table 9, with each of the Samples No. 53 and No. 54, the change in the impedance of the dielectric protection layer was large between before and after the degradation test. In the Sample No. 53 in which Si was included in the dielectric protection the impedance was at the lower limit of the tolerance range.

In contrast, with each of the Samples No. 51 and No. 52, there was hardly any change in the impedance of the dielectric protection layer between the initial stage of driving and after the accelerated degradation test.

Next, the relationship between existence of a phosphor protection layer and the image quality of PDPs were studied. The characteristics of the samples and the image quality evaluation results are shown in the Table 12.

TABLE 12

| Sample Number | Phosphor Protection Layer | Dielectric Protection Layer Si Ratio (ppm) | Image Quality Evaluation Initial Stage of Driving | Image Quality Evaluation After Degradation Test |
|---|---|---|---|---|
| P51 | Yes | 1,500 | 5 | 5 |
| P52 | Yes | 0 | 4 | 4 |
| P53 | No | 1,500 | 5 | 2 |
| P54 | No | 0 | 4 | 5 |

As shown in the Table 12, the PDP samples of No. P51 through No. P54 are the same as the Samples No. 51 and No. 54 shown in the Table 9 in terms of whether a phosphor protection layer was provided or not and the content ratios of Si in the dielectric protection layers.

As shown in the Table 12, the image quality after the accelerated degradation test of each of the samples except for the Sample No. 53 was at a passing level. Among those, the Samples No. 51 and No. 54 exhibited image quality after the tests at level 5, which is the highest level.

However, when these results are studied along with the results shown in the Table 11, with the Sample No. P54 the change in the impedance of the dielectric protection layer was as large as 45 points between before and after the accelerated degradation test. The change was considerably larger than the cases of Samples No. P51 and No. P52; therefore, it is conjectured that if the accelerated degradation test had been continued longer, the image quality must have degraded abruptly.

Accordingly, in a PDP in which a phosphor protection layer is formed so as to cover the phosphor layer, the impedance of the dielectric protection layer does not change largely, and degradation of image quality due to black noise is small, even after the panel has been driven for a long period of time.

3-3. Other Information Related to the Third Embodiment

In the third embodiment described above, the phosphor protection layer 26 is formed so as to cover all the phosphor layers 25; however, it is not necessary to cover the surfaces of all the phosphor layers 25. For example, it is possible to inhibit Si from dispersing into the discharge space from the green phosphor layer at least while the panel is driven, with an arrangement wherein the surface of only the green phosphor layer that contains Si being a Group IV element is covered with the phosphor protection layer 26. Further, even in the case where transition metal, alkali metal, alkaline earth metal (except for Mg), or the like is included in a phosphor layer, by forming the phosphor protection layer according to the present embodiment, it is possible to inhibit such elements from dispersing into the discharge spaces from the phosphor layer when discharges are generated during the driving process.

The following explains particularly advantageous effects that are achieved in the case where a phosphor protection layer is formed only on the surfaces of phosphor layers that contain Group IV elements, transition metal, alkali metal, or alkaline earth metal (except for Mg).

When a phosphor protection layer is formed, the ultraviolet ray transmittance rate is reduced by as much; therefore, when a phosphor protection layer is formed on the surfaces of all the phosphor layers for R, G, and B, the luminance is lowered by as much. In contrast, in the above arrangement, a phosphor protection layer is formed only on the surfaces of phosphor layers that contain Group IV elements, transition metal, alkali metal, or alkaline earth metal (except for Mg); therefore, it is only discharge cells for G that have reduction of luminance, and the luminance for the whole panel is improved. In addition, even if the luminance of the discharge cells for G is lowered as above, it is possible to balance the luminance between discharge cells of different colors by adjusting the driving method or designing the cell sizes.

Further, even with the green phosphor layer, it is acceptable to have an arrangement wherein the phosphor protection layer 26 covers only parts of the green phosphor layer that are easily influenced by discharges generated during the driving of the panel.

Furthermore, even in a case where a phosphor layer contains an extremely small amount of a Groups IV element, transition metal, alkali metal, or alkaline earth metal (except for Mg), it is possible to achieve effects by covering the phosphor layer with a phosphor protection layer like in the PDP 3 of the present embodiment. However, as the case of the second embodiment described above being considered, in a case where a phosphor layer contains such an element at a high ratio, it is particularly effective to have a phosphor protection layer formed. For example, a phosphor protection layer is particularly effective if one or more Group IV elements are included at a ratio higher than 1,000 mass ppm, or if transition metal, alkali metal, or alkaline earth metal (except for Mg) is included at a ratio higher than 60,000 mass ppm.

As described so far, by having an arrangement wherein having the aforementioned elements contained at a high ratio at the time of designing the panel, it is possible to improve the luminance of the whole panel, and by having an arrangement wherein one or more phosphor layers are covered with a phosphor protection layer, it is possible to suppress the change in the impedances of the dielectric protection layer and to reduce image quality degradation due to black noise, even after driving of the panel lasts for a long time period.

Accordingly, with the arrangements of the present embodiment, it is possible to achieve high luminance for the whole panel, and also possible to obtain a PDP with high image quality that has little change in the impedance of the dielectric protection layer over the course of time in the driving period and has little occurrence of black noise regardless of the length of the driving period.

The Fourth Embodiment

The following describes the PDP 4 according to the fourth embodiment, with reference to FIG. 8.

As shown in FIG. 8, the PDP 4 according to the present embodiment is characterized with the configuration of the phosphor protection layer 27 that is formed so as to cover the phosphor layers 25 on the back panel 50. Specifically, the phosphor protection layer 27 is formed with a lower layer 27*a* and an upper layer 27*b* that are laminated, the lower layer 27*a* comprising $MgF_2$ and having a thickness of 0.3 μm and the upper layer 27*b* comprising MgO and having a thickness of 0.1 μm.

Other arrangements are the same as in the PDP 3 according to the third embodiment.

Like the PDP 3 according to the third embodiment above, the PDP 4 that comprises the phosphor protection layer 27 with the above-described arrangements has an advantageous feature by which elements are inhibited from dispersing from the phosphor layers 25 when discharges are generated during driving of the panel accompanying light emission. In addition to this advantageous feature, since the PDP 4 according to the fourth embodiment comprises, as the upper layer 27*b*, a layer made of MgO, which has superior sputtering resistance, it is possible to make the thickness of the lower layer 27*a* made of $MgF_2$ as small as 0.3 μm and also possible to have ultraviolet ray (wavelength 147 nm) transmittance rate at 88%. Further, in the phosphor protection layer 27, since the thickness of the upper layer 27*b* is arranged to be smaller than that of the lower layer 27*a*, both a high transmittance rate and sputtering resistance are realized. Consequently, in the PDP 4, occurrence of black noise to be caused after the driving of the panel has lasted for a long time period is inhibited without fail, and the image quality is maintained high with more stability.

It should be noted that, like the explanation provided for the third embodiment, the PDP 4 according to the fourth embodiment may adopt one or more of different variations with respect to the manner in which the phosphor protection layer is formed and the materials to be used.

It should be also noted that in the both cases of the third embodiment and the fourth embodiment, the arrangements of the phosphor protection layer 26 and the phosphor protection layer 27 each formed on the phosphor layers 25 are not limited to those described in the third and fourth embodiments. For example, it is acceptable to change the thickness of each layer within a range that is permissible. Since there would be no problem in terms of the luminance as long as the ultraviolet ray transmittance rate is 80% or higher, it is acceptable to make each of the phosphor protection layers 26 and 27 as thick as possible until the ultraviolet ray transmittance rate gets to be exactly 80% in order to be able to more definitely inhibit the elements from dispersing from the phosphor layers during driving the panel.

INDUSTRIAL APPLICABILITY

The PDPs of the present invention are effective in realization of display devices such as ones for computers, televisions and the like, in particular display devices that have high definition and high luminance and also whose image quality is stable over the course of time.

The invention claimed is:

1. A plasma display panel in which a pair of substrates are disposed so as to oppose each other and have a discharge space therebetween and in which a dielectric protection layer including MgO and phosphor layers for red, green, and blue respectively are formed so as to face the discharge space, comprising:

each of the phosphor layers contains at least one transition metal in an amount that causes the impedance of the dielectric protection layer to rise by a same degree over the course of time in the discharge space that corresponds to the phosphor layers red, green and blue, wherein a content ratio of said at least one transition metal in each of the phosphor layers is within a range between 500 mass ppm and 30,000 mass ppm inclusive, and said at least one transition metal is selected from a group consisting of W, Mn, Fe, Co, and Ni.

2. The plasma display panel of claim 1, wherein a phosphor member included in at least one of the phosphor layers contains, in a composition thereof, said at least one transition metal.

3. The plasma display panel of claim 1, wherein the dielectric protection layer contains at least one Group IV element.

4. The plasma display panel of claim 1, wherein the dielectric protection layer contains at least one transition metal.

5. The plasma display panel of claim 1, wherein the dielectric protection layer contains at least one member of the group consisting of alkali metals and alkaline earth metals.

6. The plasma display panel of claim 1, wherein at least part of a surface of one or more of the phosphor layers facing the discharge space is covered with a phosphor protection layer, the phosphor protection layer (i) having an ultraviolet ray transmittance rate of 80% or higher, and (ii) having a function of inhibiting one or more of elements included in the one or more phosphor layers that are to degrade discharge properties of the dielectric protection layer from dispersing into the discharge space.

7. A plasma display panel in which a pair of substrates are disposed so as to oppose each other and have a discharge space therebetween and in which a dielectric protection layer including MgO and phosphor layers for red, green, and blue respectively are formed so as to face the discharge space, comprising:

each of the phosphor layers contains at least one transition metal in an amount that causes the impedance of the dielectric protection layer to rise by a same degree over the course of time in the discharge space that corresponds to the phosphor layers red, green and blue, wherein a content ratio of said at least one transition metal in each of the phosphor layers is within a range between 300 mass ppm and 120,000 mass ppm inclusive, and the content ratio is substantially same for all of the phosphor layers and said at least one transition metal is selected from the group consisting of W, Mn, Fe, Co, and Ni.

8. The plasma display panel of claim 7, wherein variations among the phosphor layers with respect to the content ratio of said at least one transition metal are no larger than 40,000 mass ppm.

9. The plasma display panel of claim 7, wherein for each of the phosphor layers, a phosphor member containing, in a composition thereof, said at least one transition metal is selected so as to be included in the phosphor layer.

10. The plasma display panel of claim 9, wherein said at least one transition metal contained in the composition of the phosphor member is in common with all of the phosphor layers.

* * * * *